US012018461B2

(12) United States Patent
Nishi

(10) Patent No.: US 12,018,461 B2
(45) Date of Patent: Jun. 25, 2024

(54) SHOVEL

(71) Applicant: SUMITOMO CONSTRUCTION MACHINERY CO., LTD., Tokyo (JP)

(72) Inventor: Takashi Nishi, Chiba (JP)

(73) Assignee: SUMITOMO CONSTRUCTION MACHINERY CO., LTD., Tokyo (JP)

( * ) Notice: Subject to any disclaimer, the term of this patent is extended or adjusted under 35 U.S.C. 154(b) by 883 days.

(21) Appl. No.: 17/036,326

(22) Filed: Sep. 29, 2020

(65) Prior Publication Data

US 2021/0010241 A1 Jan. 14, 2021

Related U.S. Application Data

(63) Continuation of application No. PCT/JP2019/014530, filed on Apr. 1, 2019.

(30) Foreign Application Priority Data

Mar. 31, 2018 (JP) ..... 2018-070465

(51) Int. Cl.
*E02F 9/22* (2006.01)
*E02F 3/43* (2006.01)
*E02F 9/20* (2006.01)

(52) U.S. Cl.
CPC ..... *E02F 9/2267* (2013.01); *E02F 3/431* (2013.01); *E02F 9/2041* (2013.01)

(58) Field of Classification Search
CPC ..... E02F 9/2267; E02F 3/431; E02F 9/2041; E02F 3/437; E02F 9/2282; E02F 9/2285; E02F 9/2296; E02F 9/2292; E02F 9/2045; E02F 9/2253; E02F 9/226
See application file for complete search history.

(56) References Cited

U.S. PATENT DOCUMENTS

| | | | | |
|---|---|---|---|---|
| 9,708,001 | B2 | 7/2017 | Arakane et al. | |
| 11,041,288 | B2 * | 6/2021 | Hiromatsu | E02F 9/20 |
| 2012/0263566 | A1 | 10/2012 | Taylor et al. | |
| 2015/0312937 | A1 | 10/2015 | Suzuki et al. | |
| 2016/0024757 | A1 * | 1/2016 | Nomura | E02F 9/2054 701/32.3 |
| 2017/0168501 | A1 | 6/2017 | Ogura et al. | |
| 2018/0002894 | A1 | 1/2018 | Yamamoto et al. | |
| 2018/0002895 | A1 | 1/2018 | Misaki | |

(Continued)

FOREIGN PATENT DOCUMENTS

| | | |
|---|---|---|
| JP | H03-065769 U | 6/1991 |
| JP | H05-297942 | 11/1993 |

(Continued)

OTHER PUBLICATIONS

International Search Report for PCT/JP2019/014530 dated Jun. 25, 2019.

*Primary Examiner* — Peter D Nolan
*Assistant Examiner* — Demetra R Smith-Stewart
(74) *Attorney, Agent, or Firm* — IPUSA, PLLC

(57) ABSTRACT

A shovel includes a lower traveling body, an upper swiveling body that is mounted on the lower traveling body so as to be able to swivel, a traveling actuator that drives the lower traveling body, and a control device that is provided in the upper swiveling body, wherein the control device operates the traveling actuator based on information about a target position.

17 Claims, 16 Drawing Sheets

(56) References Cited

U.S. PATENT DOCUMENTS

| | | | | |
|---|---|---|---|---|
| 2019/0003152 | A1 | 1/2019 | Nakamura et al. | |
| 2019/0249391 | A1* | 8/2019 | Kikuchi ..... | E02F 3/845 |

FOREIGN PATENT DOCUMENTS

| | | |
|---|---|---|
| JP | H07-158117 | 6/1995 |
| JP | H11-154014 | 6/1999 |
| JP | H11-154015 | 6/1999 |
| JP | H11-154016 | 6/1999 |
| JP | 2004-132003 | 4/2004 |
| JP | 2007-051781 | 3/2007 |
| JP | 2012-172430 | 9/2012 |
| JP | 2014-006577 | 1/2014 |
| JP | 2014-055407 | 3/2014 |
| JP | 2017-014726 | 1/2017 |
| JP | 2018-022353 | 2/2018 |
| WO | 2014/155893 | 10/2014 |
| WO | 2015/119263 | 8/2015 |
| WO | 2015/151359 | 10/2015 |
| WO | 2016/143670 | 9/2016 |
| WO | 2016/152700 | 9/2016 |

* cited by examiner

SHOVEL

RELATED APPLICATION

This application is a continuation of and claims the benefit under 35 U.S.C. 120 and 365(c) of PCT International Patent Application No. PCT/JP2019/014530 filed on Apr. 1, 2019 and designating the U.S., which claims the priority to Japanese Patent Application No. 2018-070465 filed on Mar. 31, 2018. The entire content of the foregoing applications are incorporated herein by reference.

BACKGROUND

A shovel with a traveling lever and a traveling pedal is known.

TECHNICAL FIELD

This disclosure relates to a shovel.

SUMMARY

A shovel according to an embodiment includes a lower traveling body, an upper swiveling body that is mounted on the lower traveling body so as to be able to swivel, a traveling actuator that drives the lower traveling body, and a control device that is provided in the upper swiveling body, wherein the control device operates the traveling actuator based on information about a target position.

Effects of the Invention

The above-described means provide a shovel that can reduce burden on a traveling operation.

DETAILED DESCRIPTION

In the shovel described above, an operator needs to continue to operate at least one of the traveling lever and the traveling pedal so that the shovel is continuously caused to travel. Therefore, the shovel described above may cause the operator to feel annoyed with a traveling operation.

Therefore, it is desirable to provide a shovel that can reduce burden on a traveling operation.

Figure 1:
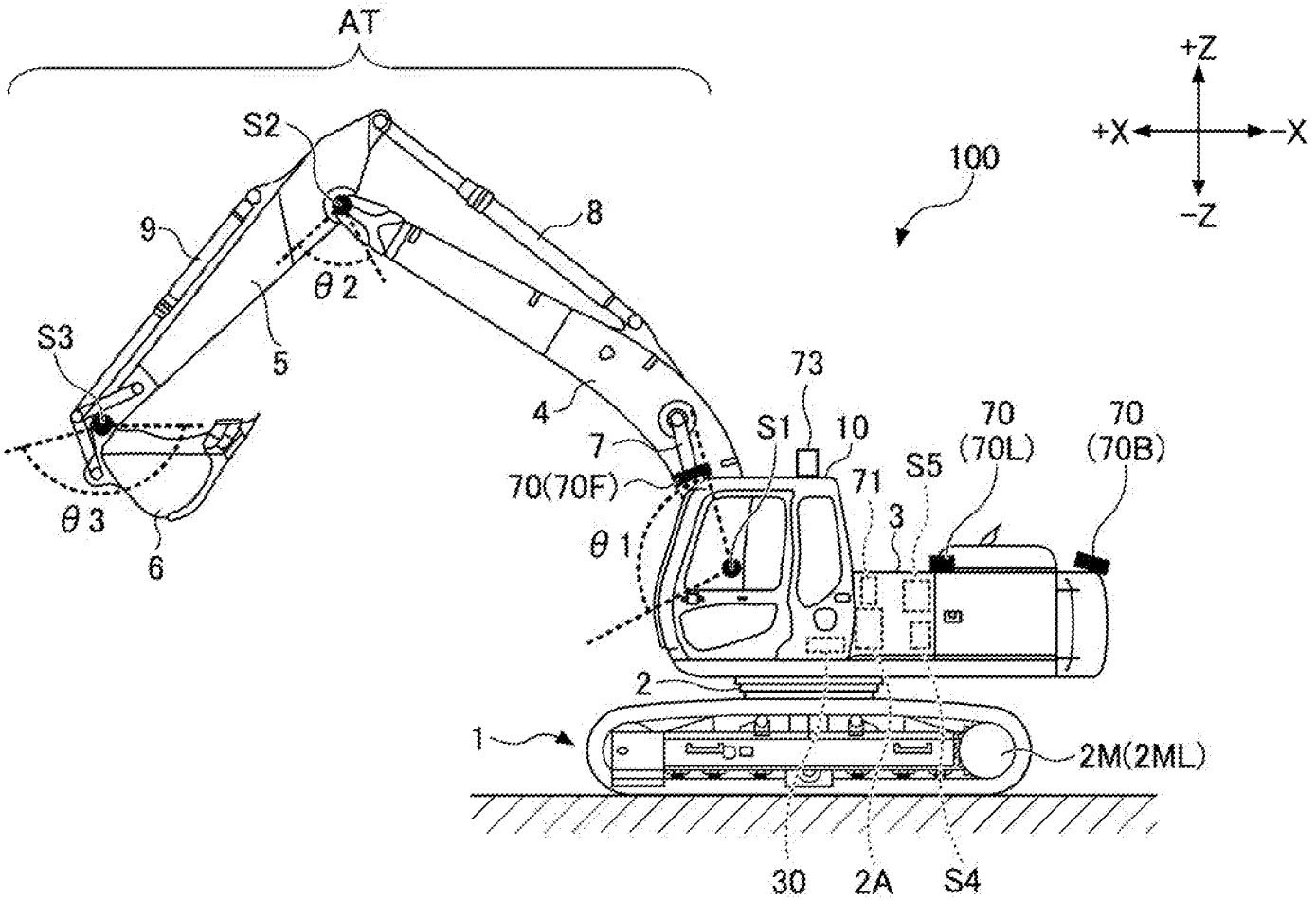
FIG. 1 is a side view of a shovel according to an embodiment of the present invention.
Figure 2:
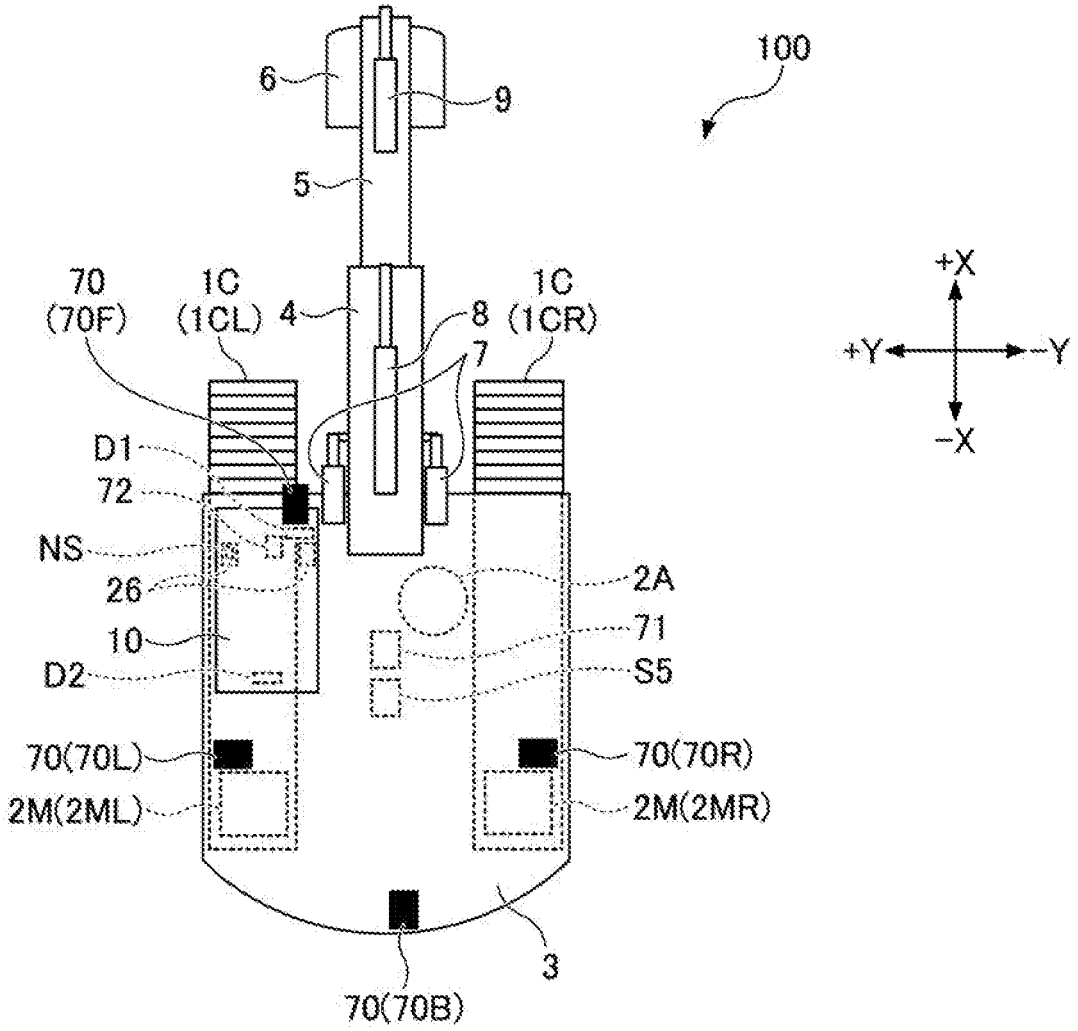
FIG. 2 is a plane view of the shovel illustrated in FIG. 1.

First, a shovel 100 as an excavator according to the embodiment of the present invention will be described with reference to FIGS. 1 and 2. FIG. 1 is a side view of the shovel 100 and FIG. 2 is a plan view of the shovel 100.

In this embodiment, the lower traveling body 1 of the shovel 100 includes a crawler 1C. The crawler 1C is driven by a traveling hydraulic motor 2M as a traveling actuator mounted on the lower traveling body 1. Specifically, the crawler 1C includes a left crawler 1CL and a right crawler 1CR. The left crawler 1CL is driven by a left traveling hydraulic motor 2ML, and the right crawler 1CR is driven by a right traveling hydraulic motor 2MR.

The upper swiveling body 3 is mounted on the lower traveling body 1 through the swiveling mechanism 2 so as to be able to swivel. The swiveling mechanism 2 is driven by a swiveling hydraulic motor 2A as a swiveling actuator mounted on the upper swiveling body 3. However, the swiveling actuator may be a swiveling motor generator as an electric actuator.

A boom 4 is attached to the upper swiveling body 3. An arm 5 is attached to the tip end of the boom 4, and a bucket 6 as an end attachment is attached to the tip end of the arm 5. The boom 4, arm 5, and bucket 6 form an excavation attachment AT, which is an example of the attachment. The boom 4 is driven by a boom cylinder 7, an arm 5 is driven by an arm cylinder 8, and a bucket 6 is driven by a bucket cylinder 9. The boom cylinder 7, the arm cylinder 8, and the bucket cylinder 9 form an attachment actuator.

The boom 4 is rotatably supported up and down with respect to the upper swiveling body 3. The boom angle sensor S1 is mounted on the boom 4. The boom angle sensor S1 can detect the boom angle θ1, which is the rotation angle of the boom 4. The boom angle θ1 is, for example, the angle of rise from the state where the boom 4 is lowered most. Therefore, the boom angle θ1 is maximized when the boom 4 is raised to the maximum.

The arm 5 is rotatably supported relative to the boom 4. An arm angle sensor S2 is mounted on the arm 5. The arm angle sensor S2 can detect the arm angle θ2, which is the rotation angle of the arm 5. The arm angle θ2 is, for example, an open angle from the most folded state of the arm 5. Therefore, the arm angle 82 is maximized when the arm 5 is stretched most.

The bucket 6 is rotatably supported relative to the arm 5. A bucket angle sensor S3 is mounted on the bucket 6. The bucket angle sensor S3 can detect the bucket angle 83, which is the rotation angle of the bucket 6. The bucket angle θ3 is the opening angle from the most closed state of the bucket 6. Therefore, the bucket angle θ3 is maximized when the bucket 6 is opened most.

In the embodiment of FIG. 1, the boom angle sensor S1, the arm angle sensor S2, and the bucket angle sensor S3 each forms a combination of an acceleration sensor and a gyro sensor. However, it may be form with only the acceleration sensor. The boom angle sensor S1 may be a stroke sensor mounted on the boom cylinder 7, a rotary encoder, a potentiometer, an inertia measuring device, or the like. The same applies to the arm angle sensor S2 and the bucket angle sensor S3.

The upper swiveling body 3 is provided with a cabin 10 as an operator's cab and a power source such as an engine 11 is mounted thereon. A space recognition device 70, a direction detecting device 71, a positioning device 73, a body inclination sensor S4, and a swivel angular velocity sensor S5 are mounted on the upper swiveling body 3. The cabin 10 is provided with an operation device 26, a controller 30, an information input device 72, a display device D1, a voice output device D2, or the like. For convenience, the side where the excavation attachment AT is mounted in the upper swiveling body 3 is the front side, and the side where the counterweight is mounted is the rear side.

A space recognition device 70 is configured to recognize an object present in the three-dimensional space around the shovel 100. The space recognition device 70 is configured to compute the distance from the space recognition device 70 or the shovel 100 to the recognized object. The space recognition device 70 may be, for example, an ultrasonic sensor, a millimeter wave radar, a monocular camera, a stereo camera, a LIDAR, a distance image sensor, or an infrared sensor. In this embodiment, the spatial recognition device 70 is a LIDAR and is configured to emit a large number of laser beams in a number of directions and receive the reflected light to compute the distance and the direction of an object from the reflected light. The same shall apply to a case where the millimeter-wave radar or the like as the space recognition device 70 emits electromagnetic waves toward the object. Specifically, the space recognition device 70 includes a frontward sensor 70F mounted at the upper surface front end of the cabin 10, a backward sensor 70B mounted at the upper surface back end of the upper swiveling body 3, a leftward sensor 70L mounted at the upper surface left end of the upper swiveling body 3, and a rightward sensor 70R mounted at the upper surface right end of the upper swiveling body 3. An upper sensor for recognizing the object present in a space above the upper swiveling body 3 may be attached to the shovel 100.

The space recognition device 70 may be configured to capture images of the perimeter of the shovel 100. In this case, the space recognition device 70 is, for example, a monocular camera having an imaging device such as a CCD or CMOS, and outputs the captured image to the display device D1.

The space recognition device 70 may be configured to sense a predetermined object within a predetermined area set around the shovel 100. Said differently, the space recognition device 70 may be configured to identify at least one of a type, a position, a shape, etc. of the object. For example, the space recognition device 70 may be configured to distinguish between a person and the object other than the person. In addition, the space recognition device 70 may be configured to identify the type of land form around the shovel 100. The type of the land form may be, for example, a hole, a slope face, or a river. In addition, the space recognition device 70 may be configured to identify the type of an obstacle. The type of the obstacle is, for example, a wire, pole, person, animal, vehicles, work equipment, construction machinery, building, or fence, etc. In addition, the space recognition device 70 may be configured to specify the type or size of a dump truck as a vehicle. Further, the space recognition device 70 may be configured to detect a person by recognizing a helmet, safety vest, or work clothing, or by identifying a predetermined mark on the helmet, safety vest, or work clothing. In addition, the space recognition device 70 may be configured to recognize the state of the road surface. Specifically, the space recognition device 70 may be configured to specify, for example, the type of object present on the road surface. The type of the object present on the road surface is, for example, tobacco, a can, PET bottle, or stone.

The direction detection device 71 is configured to detect information regarding a relative relationship between the direction of the upper swiveling body 3 and the direction of the lower traveling body 1. The direction detection device 71 may be formed by, for example, a combination of a geomagnetic sensor mounted on the lower traveling body 1 and a geomagnetic sensor mounted on the upper swiveling body 3. Alternatively, the direction detection device 71 may be formed by a combination of a GNSS receiver mounted on the lower traveling body 1 and a GNSS receiver mounted on the upper swiveling body 3. The direction detection device 71 may be a rotary encoder, a rotary position sensor, or the like. In the structure in which the upper swiveling body 3 is driven to swivel by the swivel motor generator, a direction detection device 71 may be made of a resolver. The direction detection device 71 may be mounted, for example, in a center joint disposed in connection with the swiveling mechanism 2 for realizing the relative rotation between the lower traveling body 1 and the upper swiveling body 3.

The direction detection device 71 may include a camera mounted on the upper swiveling body 3. In this case, the direction detection device 71 performs known image processing on an image (input image) captured by a camera mounted on the upper swiveling body 3 and detects the image of the lower traveling body 1 included in the input image. The direction detection device 71 specifies the longitudinal direction of the lower traveling body 1 by detecting an image of the lower traveling body 1 using a known image recognition technique. Then, an angle formed between the direction of the front and back axes of the upper swiveling body 3 and the longitudinal direction of the lower traveling body 1 is obtained. The direction of the front and back axes of the upper swiveling body 3 is obtained from a camera mounting position. In particular, because the crawler 1C protrudes from the upper swiveling body 3, the direction detecting device 71 can determine the longitudinal direction of the lower traveling body 1 by detecting an image of the crawler 1C. In this case, the direction detection device 71 may be integrated with the controller 30. The information input device 72 is configured so that the operator of the shovel can input information to the controller 30. In this embodiment, the information input device 72 is a switch panel located adjacent to a display unit of the display device D1. However, the information input device 72 may be a touch panel disposed on the display unit of the display device D1 or a voice input device such as a microphone disposed in the cabin 10. The information input device 72 may be a communication device. In this case, the operator can input information to the controller 30 via a communication terminal, such as a smartphone.

The positioning device 73 is configured to measure the present position. In this embodiment, the positioning device 73 is a GNSS receiver that detects the position of the upper swiveling body 3 and outputs the detected value to the controller 30. The positioning device 73 may be a GNSS compass. In this case, the positioning device 73 can detect the position and direction of the upper swiveling body 3.

The body inclination sensor S4 detects an inclination of the upper swiveling body 3 relative to a predetermined plane. In this embodiment, the body inclination sensor S4 is an acceleration sensor that detects an inclination angle about the front and back axes of the upper swiveling body 3 with respect to the horizontal plane and an inclination angle about the right and left axes. The front and back and left and right axes of the upper swiveling body 3 pass through a shovel center point, which is a point on the swivel axis of the shovel 100 perpendicular to each other, for example.

The swivel angular velocity sensor S5 detects the swivel angular velocity of the upper swiveling body 3. In this embodiment, it is a gyro sensor. It may be a resolver, rotary encoder, or the like. The swivel angular velocity sensor S5 may detect the swivel velocity. The swivel velocity may be computed from the swivel angular velocity.

Hereinafter, at least one of the boom angle sensor S1, the arm angle sensor S2, the bucket angle sensor S3, the body inclination sensor S4, and the swivel angular velocity sensor S5 is also referred to as an attitude detection device. The direction of the drilling attachment AT is detected, for example, based on the outputs of the boom angle sensor S1, the arm angle sensor S2 and the bucket angle sensor S3, respectively.

The display device D1 is a device for displaying information. In this embodiment, the display device D1 is a liquid crystal display located within the cabin 10. However, the display device D1 may be a display of a communication terminal such as a smartphone.

The voice output device D2 is a device that outputs voice. The voice output device D2 includes a device for outputting voice to an operator within the cabin 10 and at least one of the device for outputting voice to an operator outside the cabin 10. It may be a speaker attached to the communication terminal.

The operation device 26 is a device used by the operator to operate the actuator.

The controller 30 is a control device for controlling the shovel 100. In this embodiment, the controller 30 is formed by a computer including a CPU, RAM, NVRAM, ROM, or the like. The controller 30 reads programs corresponding to each function from the ROM and loads the program to the RAM, and performs the corresponding processing to the CPU. Each function includes, for example, a machine guidance function that guides an operator's manual operation of the shovel 100 and a machine control function that supports or causes the operator's manual operation of the shovel 100 to operate automatically or autonomously.

Figure 3:
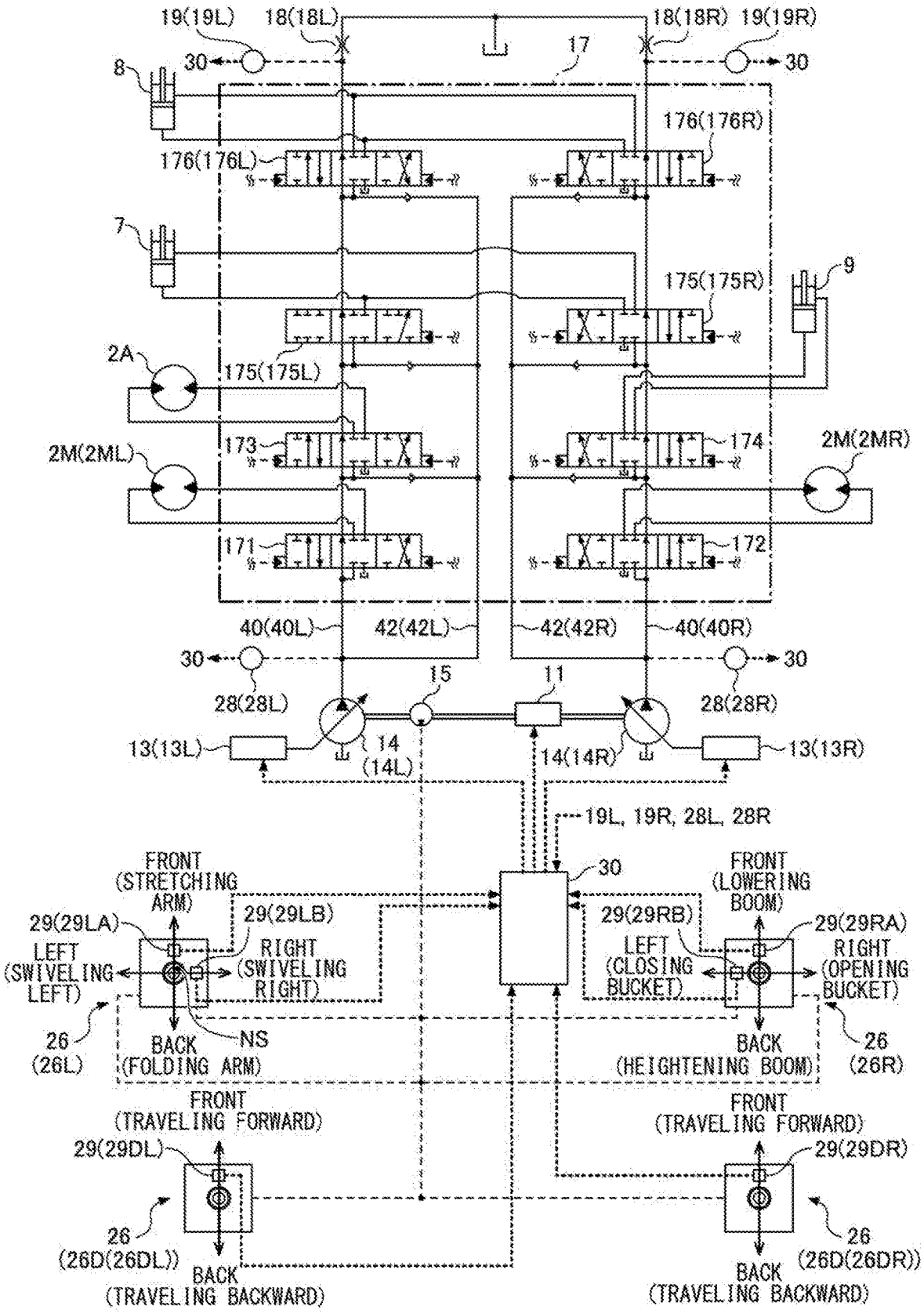
FIG. 3 is a diagram illustrating an example of a structure of a hydraulic system mounted on the shovel illustrated in FIG. 1.

Next, an example of the structure of a hydraulic system mounted on a shovel 100 will be described with reference to FIG. 3. FIG. 3 is a diagram illustrating an example of a structure of a hydraulic system mounted on the shovel 100. In FIG. 3, the mechanical power transmission system, hydraulic oil line, pilot line, and electric control system are indicated by double, solid, dashed, and broken lines, respectively.

The hydraulic system of the shovel 100 primarily includes an engine 11, a regulator 13, a main pump 14, a pilot pump 15, a control valve 17, an operation device 26, a discharge pressure sensor 28, an operation pressure sensor 29, a controller 30, and the like.

In FIG. 3, the hydraulic system is configured to circulate the hydraulic oil from the main pump 14 driven by the engine 11 to the hydraulic oil tank via a center bypass tube 40 or a parallel tube 42.

The engine 11 is a driving source of the shovel 100. In this embodiment, the engine 11 is, for example, a diesel engine that operates to maintain a predetermined speed. The output shaft of the engine 11 is coupled to the input shaft of the main pump 14 and pilot pump 15.

The main pump 14 is configured to supply the hydraulic oil to the control valve 17 via the hydraulic oil line. In this embodiment, the main pump 14 is a swash plate variable displacement hydraulic pump.

The regulator 13 is configured to control the discharge amount of the main pump 14. In this embodiment, the regulator 13 controls the discharge amount of the main pump 14 by adjusting the tilt angle of the main pump 14 in response to a control command from the controller 30.

The pilot pump 15 is configured to supply the hydraulic oil through a pilot line to a hydraulic control device including the operation device 26. In this embodiment, the pilot pump 15 is a fixed capacitive hydraulic pump.

The control valve 17 is a hydraulic controller for controlling the hydraulic system at the shovel 100. In this embodiment, the control valve 17 includes controlling valves 171-176. The controlling valve 175 includes a controlling valve 175L and controlling valve 175R, and the controlling valve 176 includes a controlling valve 176L and controlling valve 176R. The control valve 17 is configured to selectively supply one or more hydraulic actuators through the controlling valves 171-176 to the hydraulic oil discharged by the main pump 14. The controlling valves 171-176 control, for example, the flow of hydraulic oil from the main pump 14 to the hydraulic actuator and the flow of hydraulic oil from the hydraulic actuator to the hydraulic oil tank. The hydraulic actuators include a boom cylinder 7, arm cylinder 8, bucket cylinder 9, left traveling hydraulic motor 2ML, right traveling hydraulic motor 2MR, and swiveling hydraulic motor 2A.

The operation device 26 is a device used to operate the actuator by the operator. The operation device 26 includes, for example, an operation lever and an operation pedal. The actuator includes at least one of a hydraulic actuator and an electric actuator. In this embodiment, the operation device 26 is configured to supply the hydraulic oil discharged by the pilot pump 15 to a pilot port of a corresponding control valve within the control valve 17 via a pilot line. The pressure (pilot pressure) of the hydraulic oil supplied to each of the pilot ports is the pressure corresponding to the direction and operation amount of the operation device 26 corresponding to each of the hydraulic actuators. However, the operation device 26 may be electrically controlled rather than a pilot pressure system as described above. In this case, the control valve in the control valve 17 may be a electromagnetic spool valve.

The discharge pressure sensor 28 is configured to detect the discharge pressure of the main pump 14. Within this embodiment, the discharge pressure sensor 28 outputs the detected value to the controller 30.

The operation pressure sensor 29 is configured to detect the content of an operation of the operation device 26 by the operator. In this embodiment, the operation pressure sensor 29 detects the operation direction and the operation amount of the operation device 26 corresponding to each of the actuators in a form of pressure (operating pressure) and outputs the detected value to the controller 30. The content of the operation of the operation device 26 may be detected using a sensor other than an operation pressure sensor.

The main pump 14 includes a left main pump 14L and a right main pump 14R. The left main pump 14L circulates a hydraulic oil through the left center bypass tube 40L or the left parallel tube 42L to a hydraulic oil tank, and the right main pump 14R circulates hydraulic oil through the right center bypass tube 40R or the right parallel tube 42R to the hydraulic oil tank.

The left center bypass tube 40L is a hydraulic oil line passing through the controlling valves 171, 173, 175L and 176L that are disposed within the control valve 17. The right center bypass tube 40R is a hydraulic oil line passing through the control valves 172, 174, 175R and 176R that are disposed within the control valve 17.

The controlling valve 171 is a spool valve which feeds the hydraulic oil discharged by the left main pump 14L to the left traveling hydraulic motor 2ML and switches the flow of the hydraulic oil in order to discharge the hydraulic oil discharged by the left traveling hydraulic motor 2ML to the hydraulic oil tank.

The controlling valve 172 is a spool valve which feeds the hydraulic oil discharged by the right main pump 14R to the right traveling hydraulic motor 2MR and switches the flow of hydraulic oil in order to discharge the hydraulic oil discharged by the right traveling hydraulic motor 2MR to the hydraulic oil tank.

The controlling valve 173 is a spool valve that supplies the hydraulic oil discharged by the left main pump 14L to the swiveling hydraulic motor 2A and switches the flow of hydraulic oil in order to discharge the hydraulic oil discharged by the swiveling hydraulic motor 2A to the hydraulic oil tank.

The controlling valve 174 is a spool valve which feeds the hydraulic oil discharged by the right main pump 14R to the bucket cylinder 9 and switches the flow of hydraulic oil in order to discharge the hydraulic oil in the bucket cylinder 9 to the hydraulic oil tank.

The controlling valve 175L is a spool valve which switches the flow of hydraulic oil in order to supply the hydraulic oil discharged by the left main pump 14L to the boom cylinder 7. The controlling valve 175R is a spool valve which feeds the hydraulic oil discharged by the right main pump 14R to the boom cylinder 7 and switches the flow of hydraulic oil in order to discharge the hydraulic oil in the boom cylinder 7 to the hydraulic oil tank.

The controlling valve 176L is a spool valve which feeds the hydraulic oil discharged by the left main pump 14L to the arm cylinder 8 and switches the flow of hydraulic oil in order to discharge the hydraulic oil in the arm cylinder 8 to the hydraulic oil tank.

The controlling valve 176R is a spool valve which feeds the hydraulic oil discharged by the right main pump 14R to the arm cylinder 8 and switches the flow of the hydraulic oil in order to discharge the hydraulic oil in the arm cylinder 8 to the hydraulic oil tank.

The left parallel tube 42L is a hydraulic oil line disposed in parallel to the left center bypass tube 40L. The left parallel tube 42L can supply the hydraulic oil to the control valves on the downstream side when the flow of the hydraulic oil passing through the left center bypass tube 40L is restricted or interrupted by either one of the controlling valves 171, 173, and 175L. The right parallel tube 42R is a hydraulic oil line disposed in parallel to the right center bypass tube 40R. The right parallel tube 42R can supply the hydraulic oil to the control valves on the downstream side when the flow of the hydraulic oil passing through the right center bypass tube 40R is limited or shut off by either one of the control valves 172, 174, and 175R.

The regulator 13 includes a left regulator 13L and a right regulator 13R.

The left regulator 13L controls the discharge amount of the left main pump 14L by adjusting the tilt angle of the swash plate of the left main pump 14L in accordance with the discharge pressure of the left main pump 14L. Specifically, the left regulator 13L adjusts the tilt angle of a swash plate of the left main pump 14L in response to an increase in the discharge pressure of the left main pump 14L to reduce the discharge amount. The same applies to the right regulator 13R. This is provided that the absorbed horsepower of the main pump 14, which is expressed as the product of the discharge pressure and the discharge amount, does not exceed the output horsepower of the engine 11.

The operation device 26 includes a left operation lever 26L, a right operation lever 26R, and a traveling lever 26D. The traveling lever 26D includes a left traveling lever 26DL and a right traveling lever 26DR.

The left operation lever 26L is used for the swivel operation and the operation of the arm 5. The left operation lever 26L, when operated in forward and backward directions, utilizes the hydraulic oil discharged by the pilot pump 15 to Introduce a control pressure according to the lever operation amount into the pilot port of the controlling valve 176. When operated in the rightward and leftward directions, the hydraulic oil discharged by the pilot pump 15 is used to introduce the control pressure according to the lever operation amount into a pilot port of the controlling valve 173.

Specifically, the left operation lever 26L introduces the hydraulic oil to the right pilot port of the controlling valve 176L and introduces the hydraulic oil to the left pilot port of the controlling valve 176R when operated in the arm folding direction. The left operation lever 26L, when operated in an arm stretching direction, introduces the hydraulic oil to the left pilot port of the controlling valve 176L and introduces the hydraulic oil to the right pilot port of the controlling valve 176R. The left operation lever 26L introduces the hydraulic oil to the left pilot port of the controlling valve 173 when it is operated in the left swiveling direction and introduces hydraulic oil to the right pilot port of the controlling valve 173 when it is operated in the right swiveling direction.

The right operation lever 26R is used to operate the boom 4 and the bucket 6. The right operation lever 26R utilizes the hydraulic oil discharged by the pilot pump 15 when operated in the forward and backward directions to introduce a control pressure according to the lever operation amount into the pilot port of the controlling valve 175. When operated in the rightward and leftward directions, the hydraulic oil discharged by the pilot pump 15 is used to introduce the control pressure according to the amount of lever operated into the pilot port of the controlling valve 174.

Specifically, the right operation lever 26R introduces the hydraulic oil to the left pilot port of the controlling valve 175R when operated in the boom lowering direction. The right operation lever 26R, when operated in the boom heightening direction, introduces the hydraulic oil to the right pilot port of the controlling valve 175L and introduces the hydraulic oil to the left pilot port of the controlling valve 175R. The right operation lever 26R also introduces the hydraulic oil to the right pilot port of the controlling valve 174 when it is operated in the bucket closing direction, and introduces the hydraulic oil to the left pilot port of the controlling valve 174 when it is operated in the bucket opening direction.

The traveling lever 26D is used to operate the crawler 1C. Specifically, the left traveling lever 26DL is used to operate the left crawler 1CL. It may be configured to interlock with the left traveling pedal. The left traveling lever 26DL, when operated in the forward and backward directions, utilizes the hydraulic oil discharged by the pilot pump 15 to introduce the control pressure according to the lever operation amount into the pilot port of the controlling valve 171. The right traveling lever 26DR is used to operate the right crawler 1CR. It may be configured to interlock with the right traveling pedal. The right traveling lever 26DR, when operated in the forward and backward directions, utilizes the hydraulic oil discharged by the pilot pump 15 to introduce the control pressure according to the lever operation amount into the pilot port of the controlling valve 172.

The discharge pressure sensor 28 includes the discharge pressure sensor 28L and the discharge pressure sensor 28R. The discharge pressure sensor 28L detects the discharge pressure of the left main pump 14L and outputs a detected value to the controller 30. The same applies to the discharge pressure sensor 28R.

The operation pressure sensor 29 includes operation pressure sensors 29LA, 29LB, 29RA, 29RB, 29DL, and 29DR. The operation pressure sensor 29LA detects the content of the operation in the forward and backward directions by the operator relative to the left operation lever 26L in the form of pressure and outputs the detected value to the controller 30. The content of the operation is, for example, the lever operation direction and the lever operation amount (lever operation angle).

Similarly, the operation pressure sensor 29LB detects the content of the operator's operation of the left operation lever 26L in the rightward and leftward directions in the form of pressure and outputs the detected value to the controller 30. The operation pressure sensor 29RA detects the content of an operator's operation of the right operation lever 26R in the forward and backward directions in the form of pressure and outputs the detected value to the controller 30. The operation pressure sensor 29RB detects the content of the operation by the operator in the leftward and rightward directions relative to the right operation lever 26R in the form of pressure and outputs the detected value to the controller 30. The operation pressure sensor 29DL detects the content of the operation in the forward and backward directions relative to the left traveling lever 26DL by the operator in the form of pressure and outputs the detected value to the controller 30. The operation pressure sensor 29DR detects the content of the operation in the forward and backward direction relative to the right traveling lever 26DR by the operator in the form of pressure and outputs the detected value to the controller 30.

The controller 30 receives the output of the operation pressure sensor 29 and outputs a control command to the regulator 13 as needed to change the discharge amount of the main pump 14. The controller 30 receives the output of the control pressure sensor 19 disposed in the upstream of the control valve 18, outputs a control command to the regulator 13 as necessary, and changes the discharge amount of the main pump 14.

The control valve 18 includes a left control valve 18L and a right control valve 18R, and the control pressure sensor 19 includes a left control pressure sensor 19L and a right control pressure sensor 19R.

In the left center bypass tube 40L, a left control valve 18L is disposed between the controlling valve 176L, which is the lowest, and the hydraulic oil tank. Therefore, the flow of hydraulic oil discharged by the left main pump 14L is limited by the left control valve 18L. The left control valve 18L generates a control pressure for controlling the left regulator 13L. The left control pressure sensor 19L is a sensor for detecting this control pressure and outputs a detected value to the controller 30. The controller 30 controls the discharge amount of the left main pump 14L by adjusting the tilting angle of the swash plate of the left main pump 14L in response to the control pressure. The controller 30 decreases the discharge amount of the left main pump 14L as the control pressure increases, and increases the discharge amount of the left main pump 14L as the control pressure decreases. The discharge amount of the right main pump 14R is similarly controlled.

Specifically, when none of the hydraulic actuators at the shovel 100 is in the standby state as illustrated in FIG. 3, the hydraulic oil discharged by the left main pump 14L passes through the left center bypass tube 40L until the left control valve 18L reaches. The flow of the hydraulic oil discharged by the left main pump 14L increases the control pressure generated in the upstream of the left control valve 18L.

As a result, the controller 30 reduces the discharge amount of the left main pump 14L to the allowable minimum discharge amount and suppresses the pressure loss (pumping loss) when the discharged hydraulic oil passes through the left center bypass tube 40L. On the other hand, when any of the hydraulic actuators is operated, the hydraulic oil discharged by the left main pump 14L flows into the hydraulic actuator to be operated through a control valve corresponding to the hydraulic actuator to be operated. The flow of hydraulic oil discharged by the left main pump 14L decreases or disappears the amount reaching the left control valve 18L, thereby lowering the control pressure generated in the upstream of the left control valve 18L. As a result, the controller 30 increases the discharge rate of the left main pump 14L to circulate sufficient hydraulic oil in the hydraulic actuator to be operated to ensure drive of the hydraulic actuator to be operated. The controller 30 controls the discharge amount of the right main pump 14R in the same manner.

With the structure described above, the hydraulic system of FIG. 3 can reduce wasted energy consumption at the main pump 14 in standby conditions. The wasted energy consumption includes a pumping loss caused by the hydraulic oil discharged by the main pump 14 in the center bypass tube 40. The hydraulic system of FIG. 3 also ensures that sufficient hydraulic fluid is supplied from the main pump 14 to the hydraulic actuator to be actuated when the hydraulic actuator is operated.

Figure 4A:
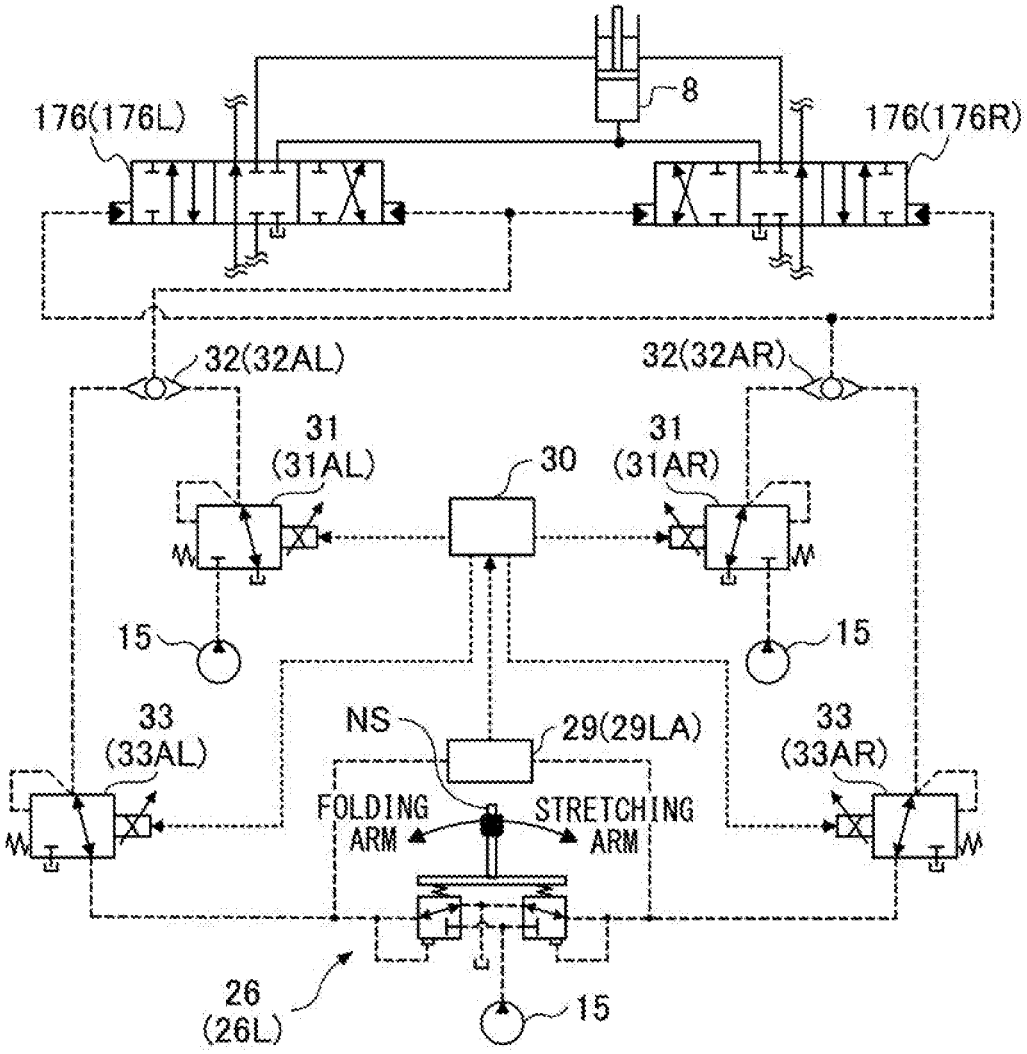
FIG. 4A is a view of a part of a hydraulic system for an operation of an arm cylinder.
Figure 4B:
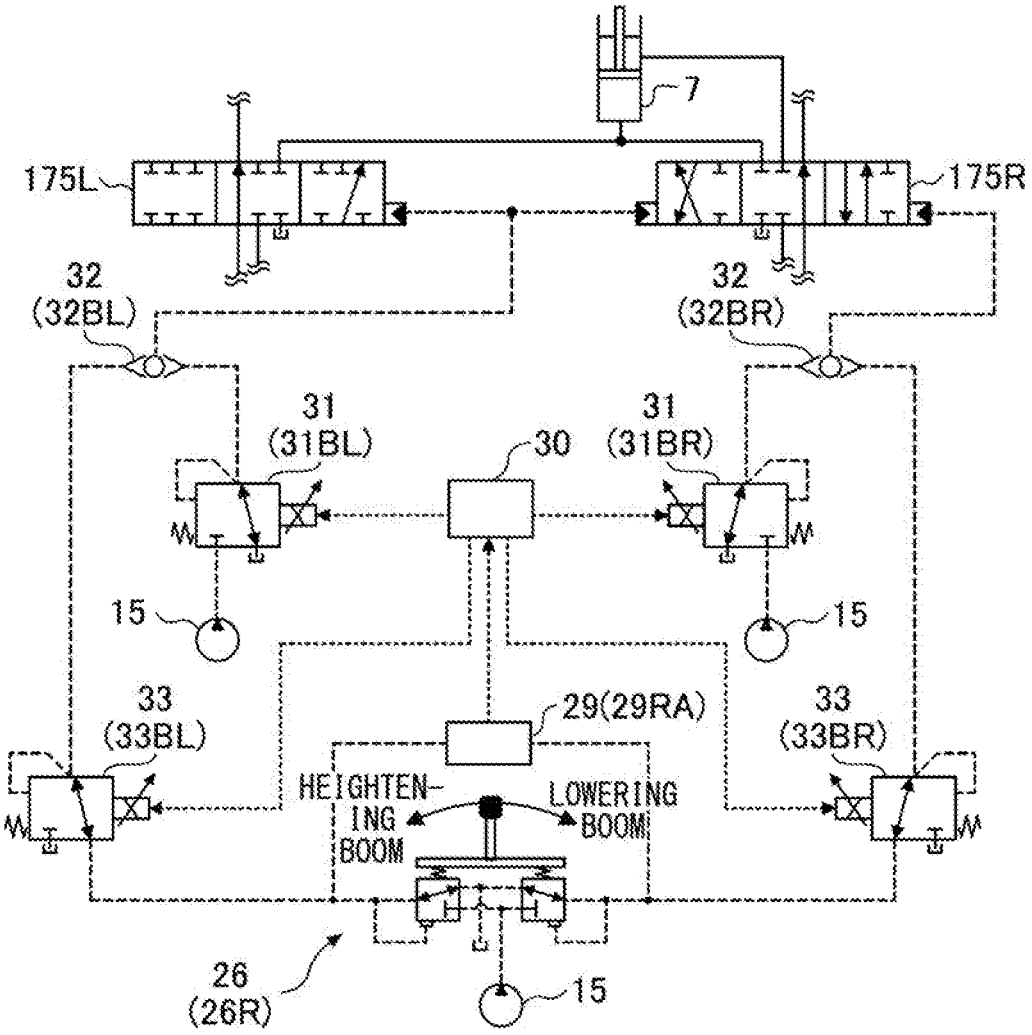
FIG. 4B is a view of a part of a hydraulic system for an operation of a boom cylinder.
Figure 4C:
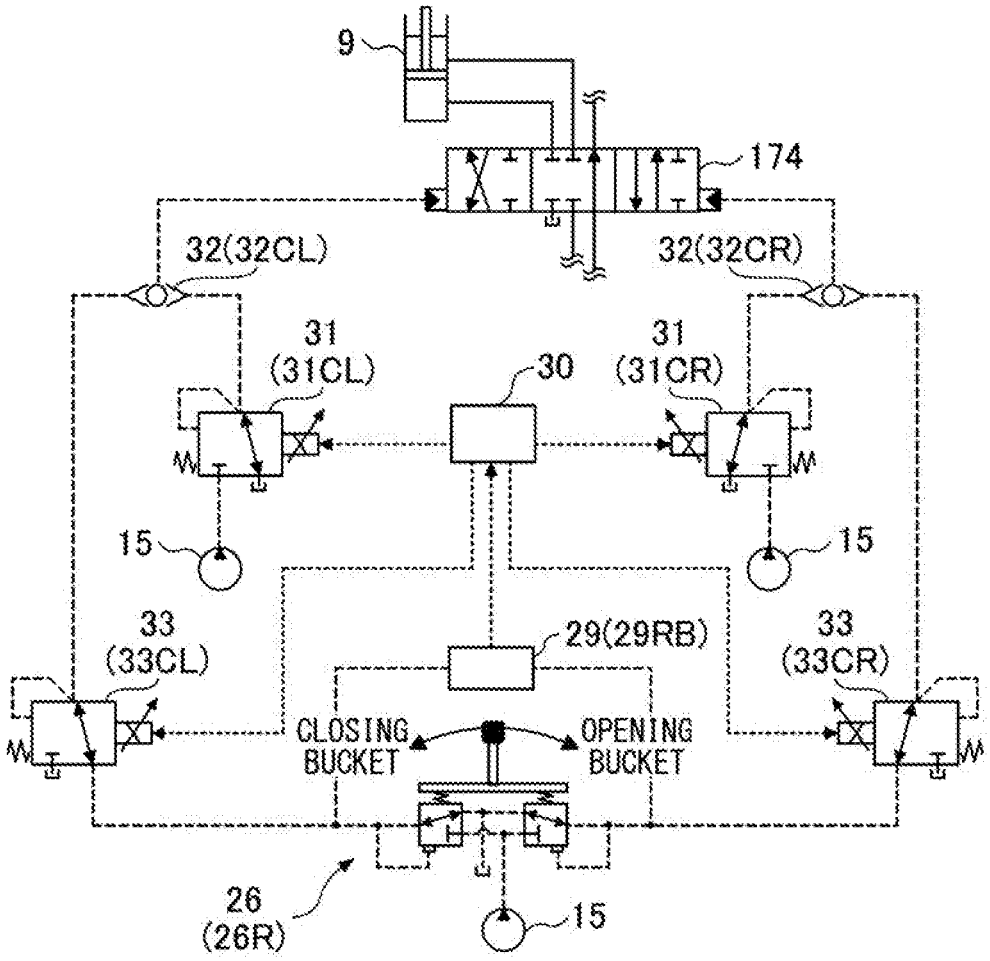
FIG. 4C is a view of a part of a hydraulic system for an operation of a bucket cylinder.
Figure 4D:
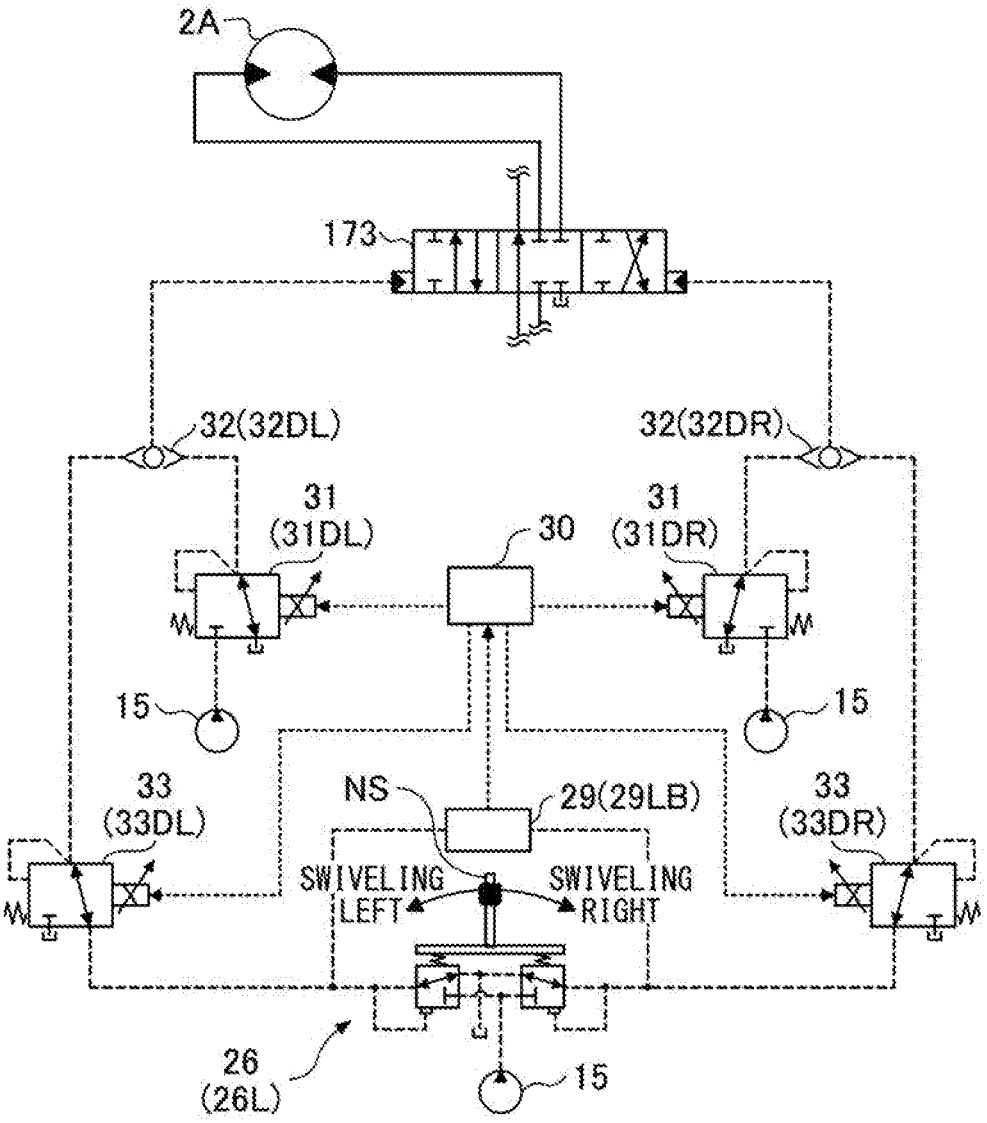
FIG. 4D is a view of a part of a hydraulic system for an operation of a swiveling hydraulic motor.
Figure 5A:
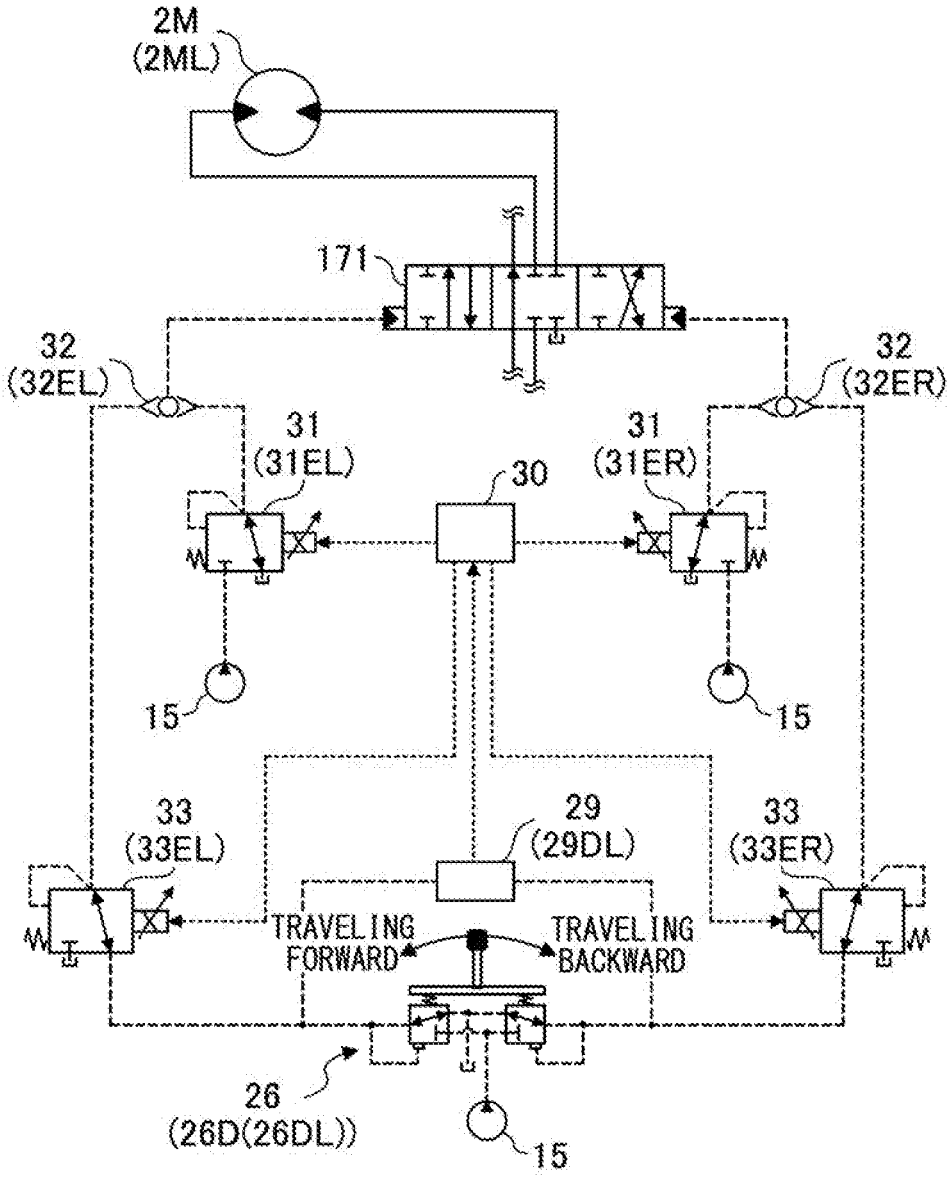
FIG. 5A is a view of a part of a hydraulic system for an operation of a left traveling hydraulic motor.
Figure 5B:
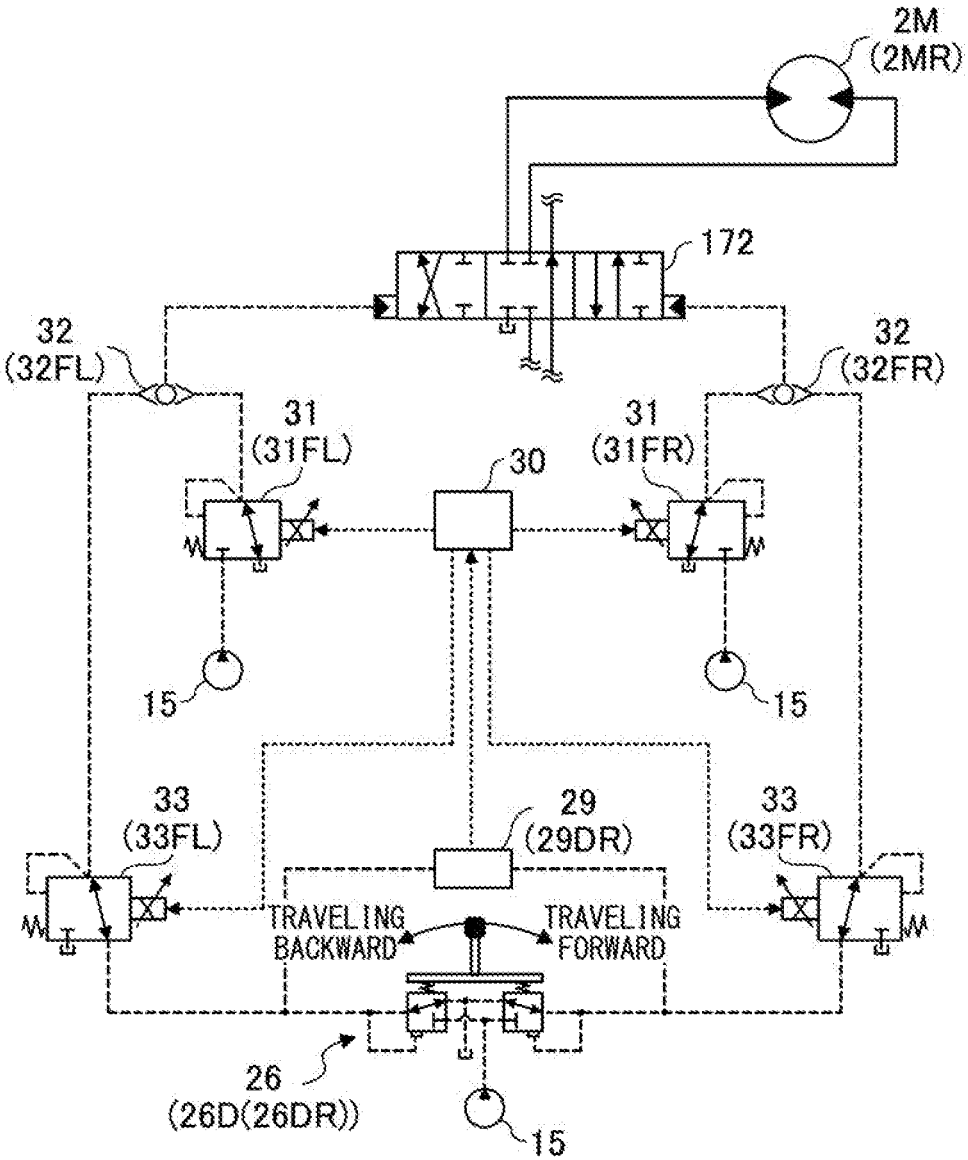
FIG. 5B is a view of a part of a hydraulic system for an operation of a right traveling hydraulic motor.

Referring now to FIGS. 4A-4D, and 5A a5B, a configuration for controllers 30 to operate actuators by machine control functions will be described. FIGS. 4A-4D and 5A-5B are views of a portion of a hydraulic system. Specifically, FIG. 4A illustrates a part of the hydraulic system for operation of the arm cylinder 8, and FIG. 4B illustrates a part of the hydraulic system for operation of the boom cylinder 7. FIG. 4C illustrates a part of the hydraulic system for operation of the bucket cylinder 9, and FIG. 4D illustrates a part of the hydraulic system for operation of the swivel hydraulic motor 2A. FIG. 5A illustrates a part of the hydraulic system for the operation of a left traveling hydraulic motor 2ML, and FIG. 5B is a diagram of a portion of the hydraulic system for the operation of a right traveling hydraulic motor 2MR.

As illustrated in FIGS. 4A-4D and 5A-5B, the hydraulic system includes a proportional valve 31, a shuttle valve 32, and a proportional valve 33. The proportional valve 31 includes proportional valves 31AL-31FL and 31AR-31FR, the shuttle valve 32 includes shuttle valves 32AL-32FL and 32AR-32FR, and the proportional valve 33 includes proportional valves 33AL-33FL and 33AR-33FR.

The proportional valve 31 functions as a control valve for a machine control. The proportional valve 31 is disposed in a pipe connecting the pilot pump 15 and the shuttle valve 32 and is configured to change the flow path area of the line. In this embodiment, the proportional valve 31 operates in response to a control command output by the controller 30. Thus, the controller 30 can supply the hydraulic oil discharged by the pilot pump 15 to the corresponding pilot port of the control valve in the control valve 17 via the proportional valve 31 and shuttle valve 32, regardless of the operator's operation of the operation device 26.

The shuttle valve 32 has two inlet ports and one outlet port. One of the two inlet ports is connected to the operation device 26 and the other is connected to the proportional valve 31. The outlet port is connected to a corresponding pilot port of control valve inside the control valve 17. Thus, the shuttle valve 32 can cause the higher of the pilot pressure generated by the operation device and the pilot pressure generated by the proportional valve 31 to act on the corresponding pilot port of the control valve.

The proportional valve 33 functions as a control valve for controlling a machine, as well as the proportional valve 31. The proportional valve 33 is disposed in the tube connecting the operation device 26 and shuttle valve 32 and is configured to change the flow path area of the line. Within this embodiment, the proportional valve 33 operates in response to control commands output by the controller 30. Therefore, the controller 30 can reduce the pressure of the hydraulic oil discharged by the operation device 26 regardless of the operation of the operation device 26 by an operator and supply the hydraulic oil to the pilot port of the corresponding control valve in the control valve 17 through the shuttle valve 32.

With this arrangement, the controller 30 may operate a hydraulic actuator corresponding to the specific operation device 26 even if no operation is performed on the specific operation device 26.

The controller 30 may also forcibly stop the operation of the hydraulic actuator corresponding to the specific operation device 26 even when the operation is performed for the specific operation device 26.

For example, as illustrated in FIG. 4A, the left operation lever 26L is used to operate the arm 5. Specifically, the left operation lever 26L utilizes hydraulic oil discharged by the pilot pump 15 to apply a pilot pressure to the pilot port of the controlling valve 176 in response to operation in the forward and backward directions. More specifically, the left operation lever 26L acts on the right pilot port of the controlling valve 176L and the left pilot port of the controlling valve 176R in accordance with the operation amount when operated in the arm folding direction (backward direction). When the left operation lever 26L is operated in the arm opening direction (forward direction), the left operation lever 26L acts on the left pilot port of the controlling valve 176L and the right pilot port of the controlling valve 176R in accordance with the operation amount.

The left operation lever 26L is provided with a switch NS. Within this embodiment, the switch NS is a push-button switch. The operator can operate the left operation lever 26L while pressing the switch NS. The switch NS may be provided on the right operation lever 26R or at other locations within the cabin 10.

The operation pressure sensor 29LA detects the content of the operation in the forward and backward directions by the operator relative to the left operation lever 26L in the form of pressure and outputs the detected value to the controller 30. The proportional valve 31AL operates in response to an electric current command output by the controller 30. The pressure of the hydraulic oil introduced from the pilot pump 15 to the right pilot port of the controlling valve 176L and the left pilot port of the controlling valve 176R through the proportional valve 31AL and shuttle valve 32AL is then adjusted. The proportional valve 31AR operates in response to the electric current command output by the controller 30. The pressure of the hydraulic oil introduced from the pilot pump 15 through the proportional valve 31AR and the shuttle valve 32AR into the left pilot port of the controlling valve 176L and the right pilot port of the controlling valve 176R is then adjusted. The proportional valves 31AL and 31AR can adjust the pilot pressure so that the control valves 176L and 176R can be stopped at any valve position.

This arrangement allows the controller 30 to supply the hydraulic oil discharged by the pilot pump 15 to the right pilot port of the controlling valve 176L and the left pilot port of the controlling valve 176R through the proportional valve 31AL and the shuttle valve 32AL, regardless of the arm folding operation by the operator. Said differently, the arm 5 can be fully folded. The controller 30 may also supply the hydraulic oil discharged by the pilot pump 15 to the left pilot port of the controlling valve 176L and the right pilot port of the controlling valve 176R through the proportional valve 31AR and shuttle valve 32AR, regardless of an arm stretching operation by the operator. Said differently, the arm 5 can be fully stretched.

The proportional valve 33AL operates in response to a control command (electric current command) output by the controller 30. The pilot pressure is then reduced by the hydraulic oil introduced from the pilot pump 15 to the right pilot port of the controlling valve 176L and the left pilot port of the controlling valve 176R through the left operation lever 26L, the proportional valve 33AL, and the shuttle valve 32AL. The proportional valve 33AR operates in response to a control command (the electric current command) output by the controller 30. The pilot pressure is then reduced by the hydraulic oil introduced from the pilot pump 15 through the left operating lever 26L, the proportional valve 33AR, and the shuttle valve 32AR to the left pilot port of the controlling valve 176L and the right pilot port of the controlling valve 176R. The proportional valves 33AL and 33AR can adjust the pilot pressure so that the control valves 176L and 176R can be stopped at any valve position.

With this structure, the controller 30 can depressurize the pilot pressure acting on the pilot port (the left pilot port of the controlling valve 176L and the right pilot port of the controlling valve 176R) on the closing side of the controlling valve 176 and forcibly stop the closing operation of the arm 5, if necessary, even when the operator is performing the arm folding operation. The same is applied to a case where the stretching operation of the arm 5 is forcibly stopped while the operator is performing the arm stretching operation.

Alternatively, the controller 30 may control the proportional valve 31AR, if desired, even if the operator is performing the arm folding operation, to increase the pilot pressure acting on the pilot port (the right pilot port of the controlling valve 176L and the left pilot port of the controlling valve 176R) on the open side of the controlling valve 176 opposite the pilot port on the closed side of the controlling valve 176, forcing the controlling valve 176 to stop the closing operation of the arm 5 by forcibly returning the controlling valve 176 to the neutral position. In this case, the proportional valve 33AL may be omitted. The same shall apply to the case in which the opening operation of the arm 5 is forcibly stopped when an operator performs the arm stretching operation.

Referring to FIGS. 4B to 4D, 5A, and 5B below, the same shall apply to the case where the operation of the boom 4 is forcibly stopped when the boom heightening operation or the boom lowering operation is performed by the operator, the case where the operation of the bucket 6 is forcibly stopped when the bucket closing operation or the bucket opening operation is performed by the operator, and the case where the swivel operation of the upper swiveling body 3 is forcibly stopped when the swivel operation is performed by the operator. The same shall apply to the case where the traveling operation of the lower traveling body 1 is forcibly stopped when the traveling operation by the operator is performed.

Also, as illustrated in FIG. 4B, the right operation lever 26R is used to operate the boom 4. Specifically, the right operation lever 26R utilizes the hydraulic oil discharged by the pilot pump 15 to apply a pilot pressure to the pilot port of the controlling valve 175 in response to an operation in the forward and backward directions. More specifically, the right operation lever 26R acts on the right pilot port of the controlling valve 175L and the left pilot port of the controlling valve 175R corresponding to the operation amount when operated in a boom heightening direction (backward direction). When the right operation lever 26R is operated in a boom lowering direction (forward direction), the pilot pressure corresponding to the operation amount is applied to the right pilot port of the controlling valve 175R.

The operation pressure sensor 29RA detects the content of the operator's operation using the to the right operation lever 26R in the forward and backward directions in the form of pressure and outputs a detected value to the controller 30.

The proportional valve 31BL operates in response to the electric current command output by the controller 30. The pilot pressure of the hydraulic oil introduced from the pilot pump 15 through the proportional valve 31BL and the shuttle valve 32BL into the right pilot port of the controlling valve 175L and the left pilot port of the controlling valve 175R is then adjusted. The proportional valve 31BR operates in response to the electric current command output by the controller 30. The pilot pressure of the hydraulic oil introduced from the pilot pump 15 through the proportional valve 31BR and the shuttle valve 32BR into the left pilot port of the controlling valve 175L and the right pilot port of the controlling valve 175R is then adjusted. The proportional valves 31BL and 31BR can adjust the pilot pressure so that the control valves 175L and 175R can be stopped at any valve position.

This structure allows the controller 30 to supply the hydraulic oil discharged by the pilot pump 15 to the right pilot port of the controlling valve 175L and the left pilot port of the controlling valve 175R through the proportional valve 31BL and shuttle valve 32BL, regardless of the operator's boom heightening operation. Said differently, the boom 4 can be heightened. The controller 30 may also supply the hydraulic oil discharged by the pilot pump 15 to the right pilot port of the controlling valve 175R through the proportional valve 31BR and the shuttle valve 32BR regardless of the boom lowering operation by the operator. Said differently, the boom 4 can be lowered.

As illustrated in FIG. 4C, the right operation lever 26R is also used to operate the bucket 6. Specifically, the right operation lever 26R utilizes the hydraulic oil discharged by the pilot pump 15 to apply a pilot pressure to the pilot port of the controlling valve 174 corresponding to the operation in the leftward and rightward directions. More specifically, the right operation lever 26R causes the pilot pressure, corresponding to the operation amount, to be applied to the left pilot port of the controlling valve 174 when the right operation lever 26R is operated in the bucket closing direction (left direction). The right operation lever 26R, when right operation lever 26R operated in the bucket opening direction (right direction), causes the pilot pressure corresponding to the operation amount to act on the right pilot port of the controlling valve 174.

The operation pressure sensor 29RB detects the content of the operator's operation of the right operation lever 26R in the leftward and rightward directions in the form of pressure and outputs the detected value to the controller 30.

The proportional valve 31CL operates in response to the electric current command output by the controller 30. The pilot pressure is then adjusted by the hydraulic oil introduced from the pilot pump 15 to the left pilot port of the controlling valve 174 through the proportional valve 31 CL and shuttle valve 32 CL. The proportional valve 31CR operates in response to the electric current command output by the controller 30. The pilot pressure is then adjusted by the hydraulic oil introduced from the pilot pump 15 to the right pilot port of the controlling valve 174 via the proportional valve 31CR and the shuttle valve 32CR. The proportional valves 31CL and 31CR can adjust the pilot pressure so that the controlling valve 174 can be stopped at an arbitrary valve position.

This structure allows the controller 30 to supply the hydraulic oil discharged by the pilot pump 15 to the left pilot port of the controlling valve 174 via the proportional valve 31CL and shuttle valve 32CL, regardless of the operator's bucket closing operation. Said differently, the bucket 6 can be closed. The controller 30 may also supply the hydraulic oil discharged by the pilot pump 15 to the right pilot port of the controlling valve 174 through the proportional valve 31CR and the shuttle valve 32CR regardless of the operator's bucket opening operation. Said differently, the bucket 6 can be opened.

As illustrated in FIG. 4D, the left operation lever 26L is also used to operate the swiveling mechanism 2. Specifically, the left operation lever 26L utilizes the hydraulic oil discharged by the pilot pump 15 to apply a pilot pressure to the pilot port of the controlling valve 173 in accordance with the operation in the leftward and rightward directions. More specifically, the left operation lever 26L causes the pilot pressure corresponding to the operation amount to be actuated on the left pilot port of the controlling valve 173 when the left operation lever 26L is operated in the left swiveling direction (left direction). When the left operation lever 26L is operated in the right swiveling direction (right direction), the pilot pressure corresponding to the operation amount is applied to the right pilot port of the controlling valve 173. The operation pressure sensor 29LB detects the content of the operation in the leftward and rightward directions relative to the left operation lever 26L by the operator in the form of pressure and outputs the detected value to the controller 30.

The proportional valve 31DL is operated in response to the electric current command output by the controller 30. The pilot pressure is then adjusted by the hydraulic oil introduced from the pilot pump 15 to the left pilot port of the controlling valve 173 through the proportional valve 31DL and shuttle valve 32DL. The proportional valve 31DR operates in response to the electric current command output by the controller 30. The pilot pressure is then adjusted by the hydraulic oil introduced from the pilot pump 15 to the right pilot port of the controlling valve 173 via the proportional valve 31DR and the shuttle valve 32DR. The proportional valve 31DL and 31DR can adjust the pilot pressure so that the controlling valve 173 can be stopped at any valve position.

This structure allows the controller 30 to supply the hydraulic oil discharged by the pilot pump 15 to the left pilot port of the controlling valve 173 through the proportional valve 31DL and shuttle valve 32DL regardless of the operator's left swiveling operation. Said differently, the swiveling mechanism 2 can swivel left. The controller 30 may also supply the hydraulic oil discharged by the pilot pump 15 to the right pilot port of the controlling valve 173 via the proportional valve 31DR and the shuttle valve 32DR regardless of the operator's right turn operation. Said differently, the swiveling mechanism 2 can swivel right.

The controller 30 may automatically rotate or brake the swiveling hydraulic motor 2A, which is an example of the actuator, in order to directly face the upper swiveling body 3 to a target construction surface by controlling at least one of the proportional valve 31DL, the proportional valve 31DR, the proportional valve 33DL, and the proportional valve 33DR by the electric current command.

For example, the condition in which the upper swiveling body 3 of the shovel 100 directly faces the target construction surface is such that the tip end of the attachment (e.g., the toe or back surface of the bucket 6 as a working portion) can be moved along the inclined direction of the target construction surface (e.g., rising slope surface) in accordance with the operation of the attachment. Specifically, the state in which the upper swiveling body 3 of the shovel 100 directly faces the target construction surface is a state in which an attachment working surface (a virtual plane including the center line of the attachment) perpendicular to the swivel plane (a virtual plane perpendicular to the swivel axis) of the shovel 100 includes a normal line of the target construction surface (in other words, a state of following the normal line of the target construction surface).

The shovel 100 is unable to move the tip end of the attachment along the direction of inclining the target construction surface when an attachment working surface of shovel 100 is not in a state containing the normal of the target construction surface, i.e., when the upper swiveling body 3 does not faces the target construction surface. As a result, the shovel 100 cannot properly form the target construction surface. In response to this situation, the controller 30 automatically rotates the swiveling hydraulic motor 2A so that the upper swiveling body 3 can directly face to the target execution surface. Thus, the shovel 100 can properly form the target construction surface.

The controller 30 determines that the shovel 100 faces the target construction surface when, for example, the vertical distance between the left end of the toe of the bucket 6 and the target construction surface (hereinafter, referred to as the "left end vertical distance") is equal to the vertical distance between the right end of the toe of the bucket 6 and the target construction surface (hereinafter, referred to as the "right end vertical distance"). Alternatively, the controller 30 may determine that the shovel 100 faces the target construction surface when the left end vertical distance is not equal to the right end vertical distance (i.e., the difference between the left end vertical distance and the right end vertical distance is zero) but less than a predetermined value. Thereafter, when the difference is less than or equal to the predetermined value, the controller 30 decelerates and stops the swiveling hydraulic motor 2A by means of a braking control of the swiveling hydraulic motor 2A.

In the above example, a directly facing control is implemented example with respect to the target execution plane is illustrated, but the execution of the positive control is not limited to the case with respect to the target execution plane. For example, tandem control may be performed during a scoop-up operation to load temporary dirt into the dump truck. Specifically, the controller 30 sets a target excavation trajectory, which is the trajectory that the toe of the bucket 6 should follow, to take dirt and sand of a desired volume (target excavation volume) into the bucket 6 in a single excavation operation. The controller 30 may be positioned in a virtual plane perpendicular to an attachment operating surface when moving the toe of the bucket 6 along a target excavation trajectory, and may face the upper swiveling body 3. In this case, the target excavation trajectory is changed each time a scooping and removing operation is performed. Therefore, the shovel 100 discharges the dirt to the loading platform of the dump truck and then aligns the upper swiveling body 3 with the virtual plane perpendicular to the operation surface of the attachment when the toe of the bucket 6 is moved along the newly set target excavation trajectory.

Also, as illustrated in FIG. 5A, the left traveling lever 26DL is used to operate the left crawler 1CL. Specifically, the left traveling lever 26DL utilizes hydraulic oil discharged by the pilot pump 15 to apply a pilot pressure to the pilot port of the controlling valve 171 corresponding to the operation in the forward and backward directions. More specifically, the left traveling lever 26DL, when operated in the traveling forward direction (forward direction), causes the pilot pressure to act on the left pilot port of the controlling valve 171 in accordance with the operation amount. When the left traveling lever 26DL is operated in the backward traveling direction (the backward direction), the pilot pressure is applied to the right pilot port of the controlling valve 171 according to the operation amount.

The operation pressure sensor 29DL detects the content of the operator's operation of the left traveling lever 26DL in the forward and backward directions in the form of pressure and outputs the detected value to the controller 30.

The proportional valve 31EL operates in response to the electric current command output by the controller 30. The pilot pressure is then adjusted by the hydraulic oil introduced from the pilot pump 15 to the left pilot port of the controlling valve 171 via the proportional valve 31EL and shuttle valve 32EL. The proportional valve 31ER operates in response to the electric current command output by the controller 30. The pilot pressure is then adjusted by the hydraulic oil introduced from the pilot pump 15 to the right pilot port of the controlling valve 171 via the proportional valve 31ER and the shuttle valve 32ER. The proportional valves 31EL and 31ER can adjust the pilot pressure so that the controlling valve 171 can be stopped at any valve position.

This structure allows the controller 30 to supply the hydraulic oil discharged by the pilot pump 15 to the left pilot port of the controlling valve 171 through the proportional valve 31EL and shuttle valve 32EL, regardless of the forward left traveling operation by the operator. Said differently, the left crawler 1CL is made travel forward. The controller 30 may also supply the hydraulic oil discharged by the pilot pump 15 to the right pilot port of the controlling valve 171 through the proportional valve 31ER and shuttle valve 32ER regardless of the left traveling backward operation by the operator. Said differently, the left crawler 1CL can be caused to travel backward.

As illustrated in FIG. 5B, the right traveling lever 26DR is used to operate the right crawler 1CR. Specifically, the right traveling lever 26DR utilizes the hydraulic oil discharged by the pilot pump 15 to apply a pilot pressure to the pilot port of the controlling valve 1.72 in response to the operation in the forward and backward directions. More specifically, the right traveling lever 26DR, when actuated in the forward direction, causes the pilot pressure to act on the right pilot port of the controlling valve 172 in accordance with the operation amount. When the right traveling lever 26DR is operated in the backward traveling direction (backward direction), the pilot pressure is applied to the left pilot port of the controlling valve 172 according to the operation amount.

The operation pressure sensor 29DR detects the content of the operation in the forward and backward directions relative to the right traveling lever 26DR by the operator in the form of pressure and outputs the detected value to the controller 30.

The proportional valve 31FL operates in response to the electric current command output by the controller 30. The pilot pressure is then adjusted by the hydraulic oil introduced from the pilot pump 15 to the left pilot port of the controlling valve 172 via the proportional valve 31FL and the shuttle valve 32FL. The proportional valve 31FR operates in response to the electric current command output by the controller 30. The pilot pressure is then adjusted by the hydraulic oil introduced from the pilot pump 15 to the right pilot port of the controlling valve 172 via the proportional valve 31FR and the shuttle valve 32FR. The proportional valves 31FL and 31FR can adjust the pilot pressure so that the controlling valve 172 can be stopped at any valve position.

This arrangement allows the controller 30 to supply the hydraulic oil discharged by the pilot pump 15 to the right pilot port of the controlling valve 172 via the proportional valve 31FL and shuttle valve 32FL regardless of the operator's right forward traveling operation. Said differently, the right crawler 1CR is made travel forward. The controller 30 may also supply the hydraulic oil discharged by the pilot pump 15 to the left pilot port of the controlling valve 172 via the proportional valve 31FR and the shuttle valve 32FR regardless of the right traveling backward operation by the operator. Said differently, the right crawler 1CR is made travel backward.

Figure 6:
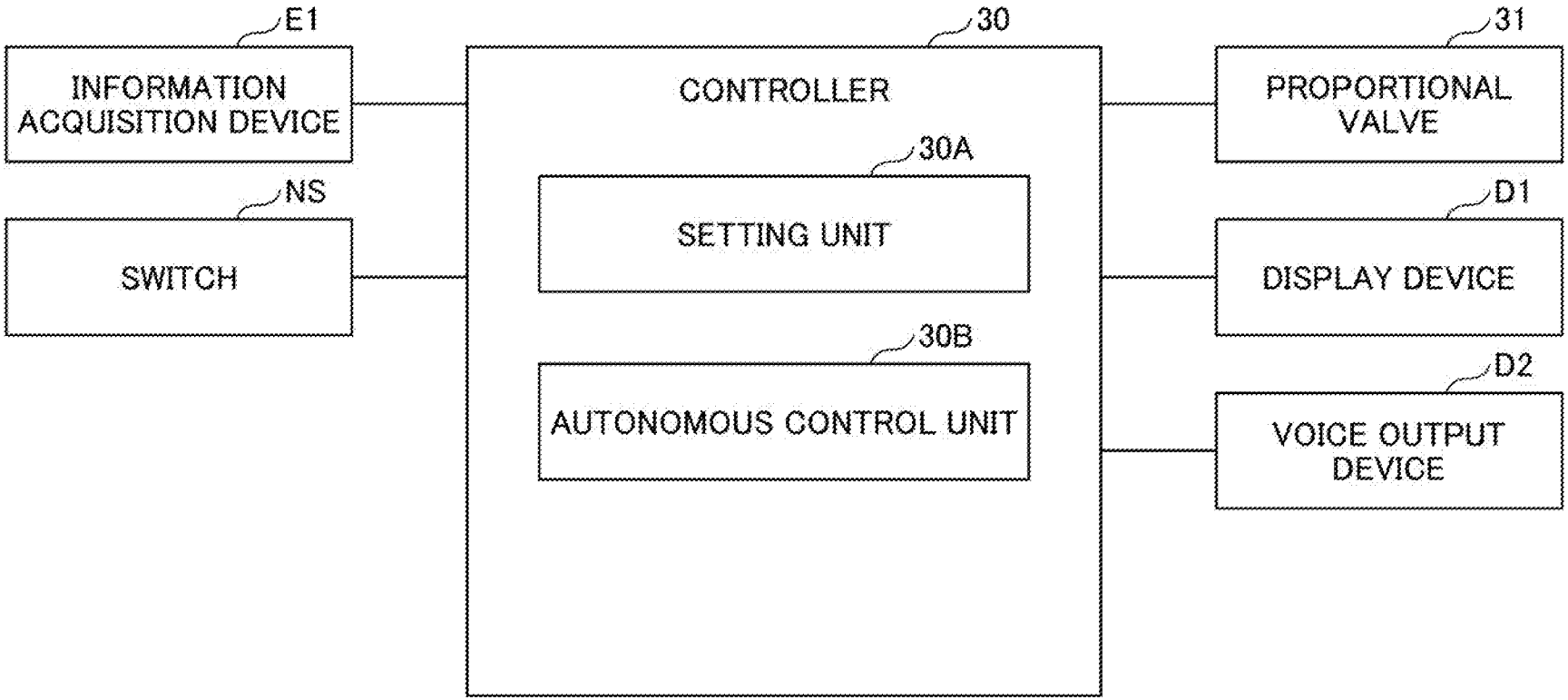
FIG. 6 is a functional block diagram of a controller.

Next, the function of the controller 30 will be described with reference to FIG. 6. FIG. 6 is a functional block diagram of the controller 30. In the example of FIG. 6, the controller 30 is configured to receive a signal output by at least one of the information acquisition device E1 and the switch NS, perform various operations, and output control commands to at least one of the proportional valve 31, the display device D1, and the voice output device D2.

The information acquisition device E1 detects information about the shovel 100. In this embodiment, the information acquisition device E1 includes at least one of a boom angle sensor S1, an arm angle sensor S2, a bucket angle sensor S3, an body inclination sensor S4, a swivel angular velocity sensor S5, a boom rod pressure sensor, a boom bottom pressure sensor, an arm rod pressure sensor, an arm bottom pressure sensor, a bucket rod pressure sensor, a bucket bottom pressure sensor, a boom cylinder stroke sensor, an arm cylinder stroke sensor, a bucket cylinder stroke sensor, a discharge pressure sensor 28, an operation pressure sensor 29, a space recognition device 70, a direction detection device 71, an information input device 72, a positioning device 73, and a communication device. For example, the information acquisition device E1 acquires at least one of information regarding the shovel 100, such as a boom angle, an arm angle, a bucket angle, a body inclination angle, a swivel angle, a boom rod pressure, a boom bottom pressure, an arm rod pressure, an arm bottom pressure, a bucket rod pressure, a bucket bottom pressure, a boom stroke amount, an arm stroke amount, a bucket stroke amount, a discharge pressure of the main pump 14, an operation pressure of the operation device 26, information regarding an object present in a three-dimensional space around the shovel 100, information regarding a relative relationship between the direction of the upper swiveling body 3 and the direction of the lower traveling body 1, information input to the controller 30, and information regarding the present position. The information acquisition device E1 may also acquire information from another machine (such as a construction machine or a flying object for acquiring on-site information).

The controller 30 has a setting unit 30A and an autonomous control unit 30B as a functional element. Each functional element may be formed by hardware or software.

The setting unit 30A is configured to assist the operator in setting various information. In this embodiment, the setting unit 30A is configured to assist in setting the information necessary for autonomously driving the shovel 100 by the operator.

For example, the setting unit 30A is configured to assist the operator in setting the destination. The destination is where the shovel 100 is driven autonomously. In other words, the destination is set as the final target position. According to the present embodiment, when a predetermined switch constituting the information input device 72 is operated, the setting unit 30A is configured to display the setting screen by the display device D1 provided with a touch panel. The setting screen is, for example, a map image containing the present position of the shovel 100. The map image may be an image captured by the camera. The operator may set a destination by tapping a point on the map image corresponding to the desired destination, for example. The setting unit 30A may display the map image used in the setting screen using an API (Application Programming Interface) related to the route search, map, or the like disclosed on an external website. The setting unit 30A may estimate the construction state based on the information acquired by the information acquisition device E1 and reflect the estimated construction state in the map image. For example, the setting unit 30A may simultaneously display the place where burial soil was provided and the place where a surface compaction operation was performed on the map image. The operator may then set the traveling route in consideration of the estimated construction states. Further, the setting unit 30A may divide the distance from the present position to the destination into a plurality of sections and set the target position for each section. In this case, when the shovel 100 reaches the end (end point) of the first section, the target position used in a traveling control of the shovel 100 is changed (reset) to the end (end point) of the next section. In this manner, the controller 30 is configured to continuously perform a travel control in each section. When the traveling route is changed depending on the situation when the shovel 100 reaches the end (end point) of the first section, the course of the next section and the target position are also changed.

The setting unit 30A is configured to assist the operator in setting the traveling route. The traveling route is the path from the present position of the shovel 100 to the desired destination. The shovel 100 is autonomously driven so that a trajectory drawn by a predetermined portion of the shovel 100 coincides with the traveling route, for example. In this case, the predetermined site is, for example, the center point of the shovel 100. The center point of the shovel 100 is, for example, a point on the swiveling axis of the shovel 100 located at a predetermined height from the contact area of the shovel 100.

In this embodiment, the operator drags a finger on a setting screen to connect a point on the map image corresponding to the present position of the shovel 100 to a point on the map image corresponding to the desired destination to set the desired traveling route, for example. The setting unit 30A may set a destination corresponding to a point where a finger of the operator is separated from the touch panel. In this case, the operator can simultaneously set the traveling route and the destination without setting the destination in advance.

If the display device D1 is not provided with a touch panel, the operator may use a button or the like on the switch panel to set the destination and traveling route while moving the cursor.

Alternatively, the setting unit 30A may automatically set the traveling route based on the present position of the shovel 100, the destination, and the map information when the destination is set. In this case, the map information includes, for example, information on ground irregularities and information on features such as a paved road, unpaved road, building, river or pond. The setting unit 30A may set a traveling route for avoiding an obstacle based on the information acquired by an information acquisition device E1 including, for example, a communication device or space recognition device 70, after recognizing the latest work conditions including the position of the obstacle such as a hole, burial soil, material, and dirt (for example, dirt dropped from a dump truck or the like). The material includes a sandbag, tetrapod ("tetrapod" is a registered trademark), concrete block, sheet pile, etc. As described above, the setting unit 30A can set the traveling route in consideration of the latest construction states. Alternatively, the setting unit 30A may set the traveling route based on the past traveling trajectory. In this case, the controller 30 may be configured to store the traveling trajectory of the shovel 100 on a non-volatile storage medium for a predetermined period of time.

The autonomous control unit 30B is configured to autonomously operate the shovel 100. In the present embodiment, the autonomous control unit 30B is configured to autonomously travel the shovel 100 along the traveling route set by the setting unit 30A.

The autonomous control unit 30B may, for example, start autonomous traveling of the shovel 100 when the autonomous traveling switch in the switch panel installed in proximity to the display unit of the display device D1 is depressed. The autonomous travel switch may be a software button displayed on the display D1 having the touch panel. Alternatively, the autonomous control unit 30B may start autonomous travel of the shovel 100 when the traveling lever 26D is tilted while a switch provided at the tip end of the traveling lever 26D is depressed. Alternatively, the autonomous control unit 30B may start the autonomous traveling of the shovel 100 when a predetermined operation is performed by a communication terminal carried by the operator outside the cabin 10. The operator of the shovel 100 may, for example, press the autonomous traveling switch to start autonomous traveling of the shovel 100 at the time of lubrication or at the end of the operation to allow the shovel 100 located at the work site to independently travel to a predetermined position.

The autonomous control unit 30B determines the movement of the actuator based on the set traveling route, for example. For example, when driving the shovel 100, an appropriate driving method is selected from a spin turn, swivel turn, slow turn, or straight travel to determine how to move the traveling hydraulic motor 2M. In this case, the autonomous control unit 30B may determine not only the movement of the traveling actuator such as the traveling hydraulic motor 2M but also the necessity of the operation of the swiveling mechanism 2. To prevent contact between the shovel 100 and an external object while driving the shovel 100 in an appropriate position. It may also be determined whether the excavation attachment AT is likely to come into contact with a peripheral device or other construction machine to determine whether operation of the excavation attachment AT is necessary.

In this embodiment, the autonomous control unit 30B can operate the actuator autonomously by providing the electric current command to the proportional valve 31 and individually adjusting the pilot pressure acting on the controlling valve corresponding to the actuator. For example, the left traveling hydraulic motor 2ML can be operated regardless of whether the left traveling lever 26DL is tilted, and the right traveling hydraulic motor 2MR can be operated regardless of whether the right traveling lever 26DR is tilted. Similarly, the left traveling hydraulic motor 2ML can be operated regardless of whether the left traveling pedal has been stepped on. The right traveling hydraulic motor 2MR can be operated regardless of whether the right traveling pedal has been folded. The same applies to the arm cylinder 8 and the swiveling hydraulic motor 2A concerning the left operation lever 26L and the boom cylinder 7 and bucket cylinder 9 concerning the right operation lever 26R.

Specifically, as illustrated in FIG. 5A, the autonomous control unit 30B is configured to output the electric current command to the proportional valve 31EL to adjust the pilot pressure acting on the left pilot port of the controlling valve 171. With this structure, even when neither the left traveling lever 26DL nor the left traveling pedal is operated in the forward direction, at least one of the left traveling lever 26DL and the left traveling pedal can generate the same pilot pressure as actually operated in the forward direction, allowing the left traveling hydraulic motor 2ML to rotate in the regular direction. The same applies to a case where the left traveling hydraulic motor 2ML is rotated in the reverse direction and the case of rotating the right traveling hydraulic motor 2MR in the forward or reverse direction.

The autonomous control unit 30B may be configured to repeatedly acquire information regarding the position of the shovel 100 based on the output of the positioning device 73 at a predetermined control cycle. Further, the direction detecting device 71 may be configured to repeatedly acquire information on the relative relationship between the direction of the upper swiveling body 3 and the direction of the lower traveling body 1 based on the output of the direction detecting device 71 at a predetermined control cycle. The autonomous control unit 30B may be configured to feed back the acquired information so that the shovel 100 can continue to travel along a desired route in a desired position.

In this structure, the autonomous control unit 30B can travel the lower traveling body 1 while, for example, the direction of the upper swiveling body 3 and the direction of the lower traveling body 1 are the same. Therefore, it is possible to stabilize the driving attitude of the shovel 100 when, for example, the shovel 100 is driven autonomously over a relatively long distance.

Alternatively, the autonomous control unit 30B may drive the lower traveling body 1 in a state in which the direction of the upper swiveling body 3 is different from the direction of the lower traveling body 1. Therefore, the shovel 100 can be moved in a short period of time when the shovel 100 is driven autonomously by a relatively short distance, for example, when the shovel 100 is moved intermittently along the slope. This is because the time required for aligning the direction of the upper swiveling body 3 and the direction of the lower traveling body 1 can be omitted.

Figure 7:
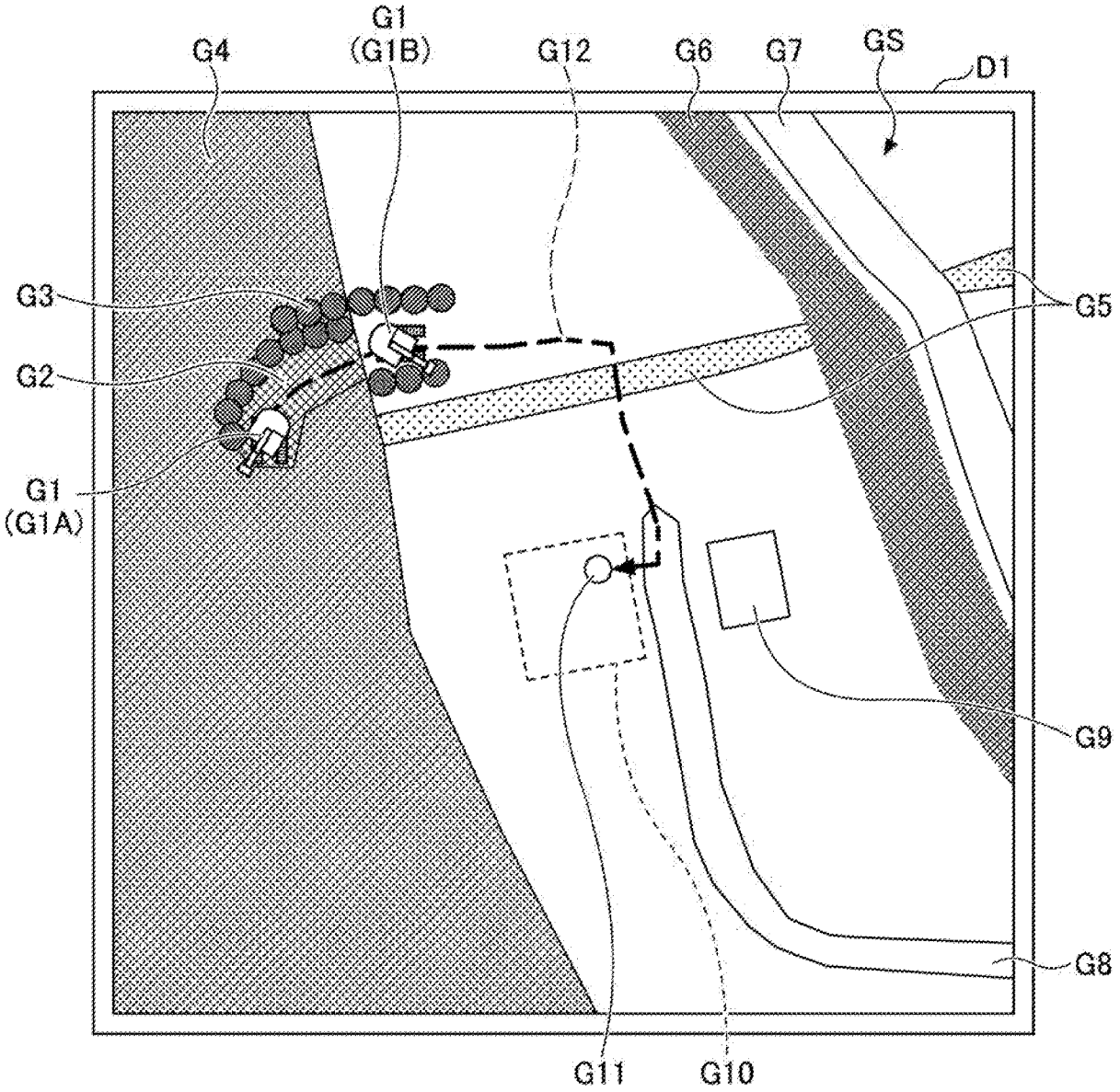
FIG. 7 illustrates an example of displaying a setting screen.

Next, a process of setting the traveling route by the controller 30 will be described with reference to FIG. 7. FIG. 7 illustrates an example of the display of the setting screen GS displayed on the display device D1.

The setting screen GS includes a shovel graphic G1, landfill graphic G2, sandbag graphic G3, river graphic G4, irrigation channel graphic G5, levee graphic G6, paved road graphic G7, unpaved road graphic G8, office graphic G9, parking field graphic G10, destination graphic G11, and traveling route graphic G12. The landfill graphic G2 and sandbag graphic G3 may be updated as the work progresses.

An actual road corresponding to the paved road graphic G7 of the setting screen is subjected to a search by an API for route search, etc. published on an external website. However, the work site of the shovel 100 often do not have nearby roads. For this reason, the controller 30 may not be able to set the traveling route for moving the shovel 100 from its present position to its destination simply by using the route search function of the externally published API. Therefore, in the present embodiment, the structure in which the traveling route can be set even at the work site of the shovel 100 and the shovel 100 can be moved based on the set route will be described.

The shovel graphic G1 is a figure illustrating the position of the shovel 100. In the example of FIG. 7, the shovel 100 includes a shovel 100A as its own machine in which a display device D1 is installed and a shovel 100B as another machine working around the shovel 100A. The setting screen GS includes a shovel graphic G1A corresponding to the shovel 100A and a shovel graphic G1B corresponding to the shovel 100B. The shovel graphic G1A indicates the position of the shovel 100A. The shovel graphic G1B indicates the position of the shovel 100B. The controller 30 determines the display position of the shovel graphic G1A based on the output of the positioning device 73 mounted on the shovel 100A, for example. The same applies to the shovel graphic G1B.

The landfill graphic G2 and sandbag graphic G3 are examples of graphics generated based on information updated at relatively short intervals. In the example of FIG. 7, these graphics are generated based on the information output by the space recognition device 70.

The river graphic G4, irrigation channel graphic G5, levee graphic G6, paved road graphic G7, unpaved road graphic G8, office graphic G9, and parking field graphic G10 are examples of geometrical graphics generated based on information updated at a relatively long interval. In the example of FIG. 7, the graphics are generated based on map information. The graphics may be part of a map image.

The destination graphic G11 is a graphic displayed when the setting unit 30A sets the destination. For example, it is displayed when the inside of the parking field graphic G10 indicated by a dashed line frame is tapped by the operator. In the example of FIG. 7, the destination graphic G11 is a circular mark, but may also be a mark having other shapes, such as a triangle, square, or ellipse.

The traveling route graphic G12 is a linear shape displayed when the setting unit 30A sets the traveling route. For example, when a dragging operation is performed from the position where the shovel graphic G1A is displayed, it is displayed along the trajectory of the dragging operation. Then, the traveling route graphic G12 terminates at a point where the finger is separated from the touch panel. In the example of FIG. 7, it is displayed as a dashed arrow toward the destination graphic G11.

The work site of the shovel 100 may be non-uniform in ground stability, as opposed to a place where a road is laid. For this reason, it is desirable to use a route that has been passed once in the past. Accordingly, the setting unit 30A may set a traveling route such as the shortest route based on the traveling trajectory during past operations.

When it is determined that the trajectory of the drag operation is inappropriate, the setting unit 30A may display the trajectory of the drag operation on the setting screen GS without displaying the traveling route graphic G12. To prompt the operator to set the appropriate route. The setting unit 30A determines that the trajectory of dragging operation is improper when, for example, dragging operation is performed to cross the river diagram G4.

Thereafter, when the autonomous traveling switch is depressed, the autonomous control unit 30B drives the shovel 100A autonomously along the set traveling route. The shovel 100A determines the positions of the material, sandbag, step, burial soil, hole, etc. based on the information acquired by the information acquisition device E1, and travels along the traveling route to a point corresponding to the destination graphic G11 while autonomously avoiding the material, sandbag, step, pile, hole, etc. In the example of FIG. 7, while the shovel 100A is traveling autonomously, the operator of the shovel 100A is seated in the driver seat within the cabin 10, but may be present outside the cabin 10. Said differently, the shovel 100A may perform a driverless operation.

The setting screen GS may be displayed continuously while the shovel 100A is traveling autonomously. This is in order to enable the operator to understand the movement of the shovel 100A.

In the example illustrated in FIG. 7, the landfill graphic G2, the sandbag graphic G3, the river graphic G4, the irrigation channel graphic G5, the levee graphic G6, the paved road graphic G7, the unpaved road graphic G8, the office graphic G9, and the parking field graphic G10 in the setting screen GS may be images captured by a flight object such as a quad copter.

With this structure, the operator of the shovel 100A can independently travel to the destination simply by setting a route to the destination. For example, when an operator arrives at the work site by car, the shovel 100A will autonomously travel from the parking lot to the set destination if the operator sets the predetermined location of the parking lot as the destination by a portable terminal device. In this case, the controller 30 may perform a travel control so that the set destination (target position) and the center of the shovel 100A correspond to each other, and the travel control may be performed so that the elevation door of the cabin 10 corresponds to each other. This allows the operator to ride on the shovel 100A without moving from the car parking lot to the shovel 100A parking lot. Accordingly, the operator, when boarding the shovel 100A, does not have to pass through a muddy work site and prevents the inside of the cabin 10 from becoming dirty due to mud or the like.

Figure 8:
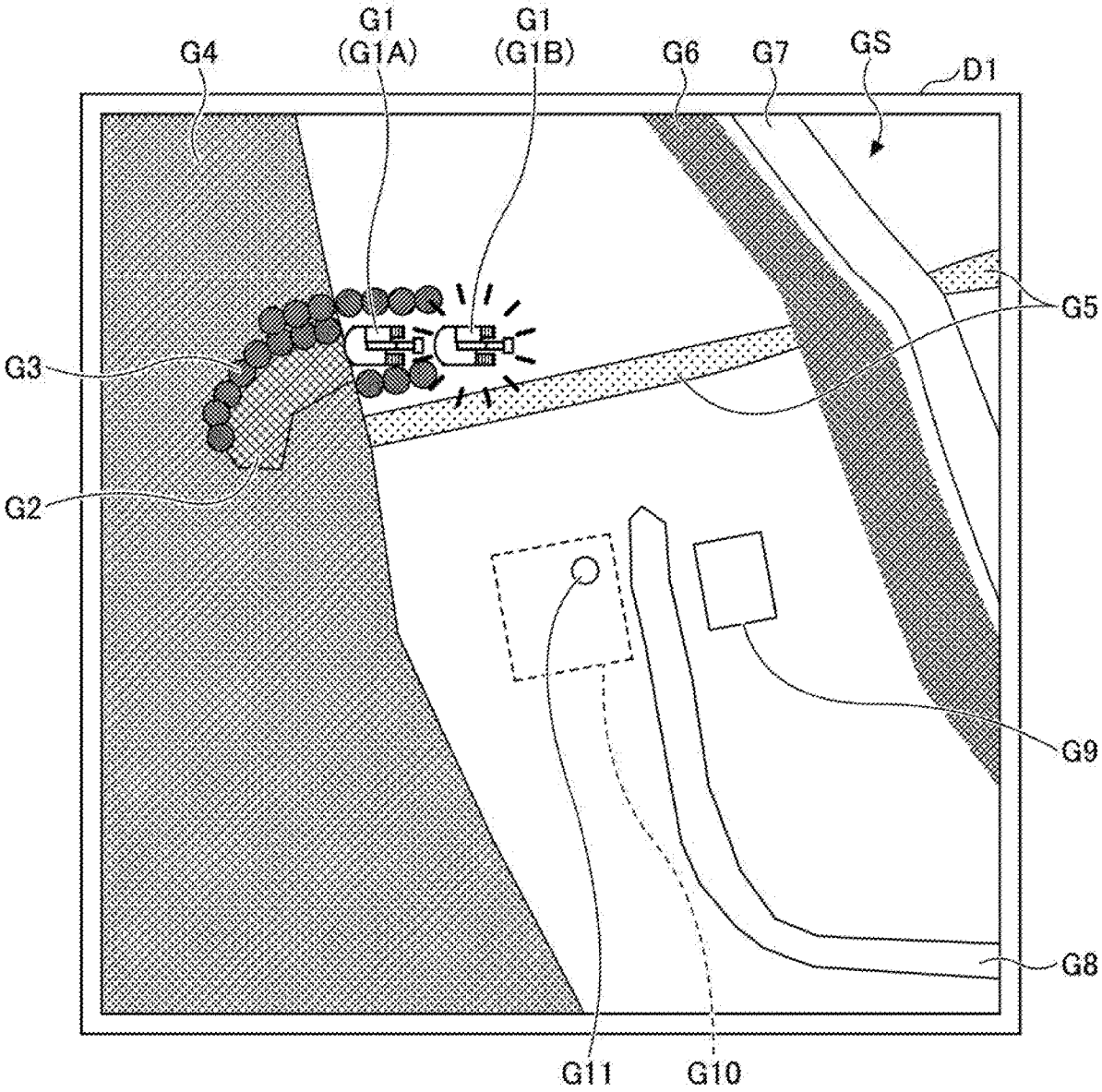
FIG. 8 illustrates another example of the displaying setting screen.

Next, another example of autonomous travel will be described with reference to FIG. 8. FIG. 8 illustrates another display example of the setting screen GS displayed on the display device D1.

In the example of FIG. 8, the autonomous control unit 30B is configured to autonomously travel the shovel 100A by causing the shovel 100B as a preceding object to follow the shovel 100A without using a traveling route. Therefore, the traveling route is not set and the traveling route graphic G12 is not displayed.

In the example of FIG. 8, the setting unit 30A is configured to assist the operator in setting the antenna object. A preceding object as an object (destination) is an object to follow the shovel 100A when the shovel 100A is driven autonomously. Typically, it is another shovel that has the same destination. However, the preceding object may be a person or other self-propelled object such as a vehicle.

In the example of FIG. 8, the operator sets the destination, for example, by tapping a point on the map image corresponding to the desired destination. Then, by tapping the shovel graphic G1B corresponding to the shovel 100B, the shovel 100B is set as a preceding shovel. In this case, the setting unit 30A may highlight the shovel graphic G1B so that the operator can recognize that the shovel 100B has been set as the preceding shovel. The highlighting includes, for example, blinking. FIG. 8 illustrates a state in which the shovel graphic G1B blinks. The operator of the shovel 100A starts autonomous traveling of the shovel 100A by pressing an autonomous traveling switch at the time of fuel filling or completing the operation, for example. The shovel 100A located at the work site follows the shovel 100B and travels autonomously, stopping when it reaches its destination. If the destination of the shovel 100A is the same as the destination of the shovel 100B, the destination setting may be omitted.

The autonomous control unit 30B estimates a traveling trajectory of the shovel 100B which precedes based on the information acquired by the information acquisition device E1 including, for example, a communication device or a space recognition device 70. The autonomous control unit 30B drives the shovel 100A autonomously to trace the traveling trajectory. Said differently, the autonomous control unit 30B performs the travel control of the shovel 100 so that the shovel 100 follows the preceding shovel 100B. The shovel 100A may be configured to travel along the traveling trajectory of the shovel 100B to a point corresponding to the destination graphic G11 while autonomously avoiding the sandbag, step, hole, or the like. Said differently, it is not necessary to follow the traveling trajectory of the shovel exactly the same as the traveling trajectory of the shovel 100B, but may deviate from the traveling trajectory of the shovel 100B, if necessary. In the example of FIG. 8, as in the example of FIG. 7, while the shovel 100A is traveling autonomously, the operator of the shovel 100A is seated in the driver seat in the cabin 10, but may be outside the cabin 10. Said differently, the shovel 100A may perform a driverless operation.

The setting screen GS may be displayed continuously while the shovel 100A is traveling autonomously. This is to enable the operator to understand the movement of the shovel 100A.

With this structure, the operator of the shovel 100A can autonomously drive the shovel 100A to the destination simply by setting the preceding object.

Figure 9:
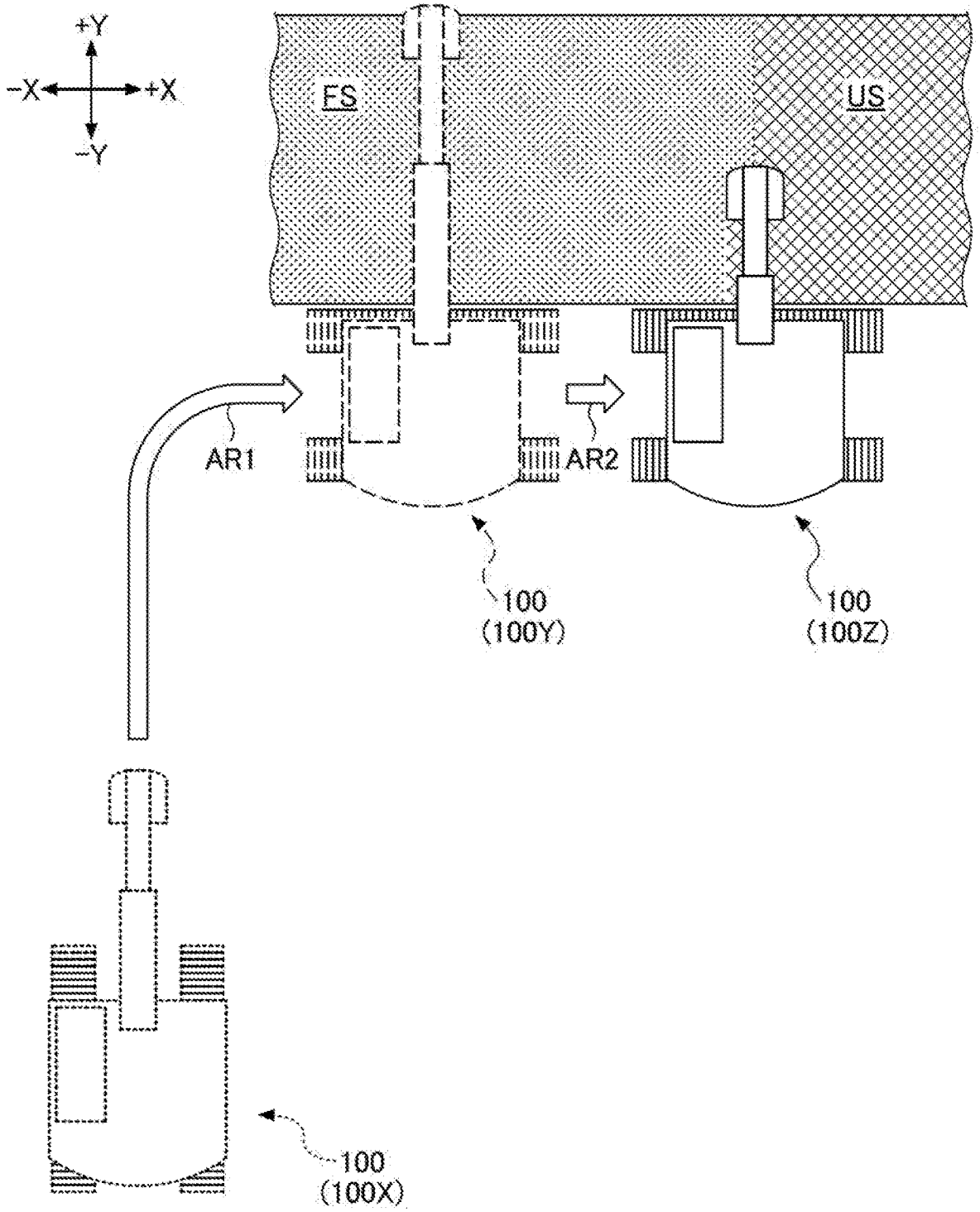
FIG. 9 is a plan view of a shovel for performing a slope work.

Next, another implementation example of autonomous travel will be described with reference to FIG. 9. FIG. 9 illustrates a plan view of the shovel 100 a slope work. The graphic 100X depicted with a dashed line in FIG. 9 indicates the state of the shovel 100 at a position away from a slope, the graphic 100Y depicted with a broken line indicates the state of the shovel 100 when the shovel 100 directly faces the slope, and the graphic 100Z depicted with a solid line indicates the state of the current shovel 100 after moving a short distance along the slope. The dot pattern area FS represents the slope after a finishing operation, and a cross hatch pattern area US represents the slope before performing the finishing operation.

In the example of FIG. 9, the setting unit 30A is structured to assist the operator in setting the work target. The object of construction is, for example, the slope subject to the slope work, a ground subject to a horizontal drawing operation, or a hole subject to deep excavation work.

In the example of FIG. 9, for example, the operator sets the slope subjected to the slop work as a construction target by designating a part of the image corresponding to the desired slope on the setting screen GS. When the construction target is set, the setting unit 30A automatically sets the traveling route from the present position to the construction target based on the present position of the shovel 100, the position of the construction target, and the map information. The setting unit 30A may set a traveling route for avoiding an obstacle based on the information acquired by the information acquisition device E1 including the communication device or the space recognition device 70 after recognizing the latest work conditions including the location of the obstacle, for example.

Thereafter, when the operator of the shovel 100 presses the autonomous travel switch, the autonomous control unit 30B allows the shovel 100 to independently travel along the set traveling route. The shovel 100, for example, travels from a position of the graphic 100X drawn with a broken line in FIG. 9 to a position of a graphic 100Y drawn with a broken line along a traveling route shown with an arrow AR1. In this case, the destination is, for example, the start position of the slope work. As described above, the shovel 100 autonomously avoids the material, sandbag, step, burial soil, hole, etc., and travels along the traveling route to the construction target (the slope subject to the slope work). Then, the shovel 100 stops at a point where the shovel 100 directly faces the slope to be subjected to the slope operation, as indicated by the graphic 100Y depicted by the broken line in FIG. 9. In the example of FIG. 9, the shovel 100 stops the lower traveling body 1 in a direction parallel to the X-axis so that it can move along the slope. In this state, the shovel 100 may perform a finishing work utilizing a excavation attachment AT. In the example of FIG. 9, while the shovel 100 is traveling autonomously, the operator of the shovel 100 is seated in the driver seat within the cabin 10, but may be outside the cabin 10. Said differently, the shovel 100 may be subjected to the driverless operation.

With this structure, the operator of the shovel 100 can autonomously drive the shovel 100 to the position of the construction target by merely setting the construction target. In this case, the target position used in the drive control of the shovel 100 is set as the target position. Specifically, the operator can independently travel the shovel 100 to the slope position by simply setting the slope position to be subjected to the slope work and stop the shovel 100 in a state directly facing the slope by using the facing control described above.

The autonomous control unit 30B may be configured to autonomously travel the shovel 100 during a predetermined operation such as a slope work. For example, if the operator of the shovel 100 depresses an autonomous travel switch when the finishing work is completed on a part of the slope subject to the slope work, the autonomous control unit 30B may allow the shovel 100 to travel autonomously based on the predetermined movement direction and movement distance. In the example of FIG. 9, the autonomous control unit 30B moves the shovel 100 to a destination (target position) set at a predetermined distance in an extension direction of the slope (+X direction) as illustrated by an arrow AR2 each time the autonomous travel switch is depressed. In this case, the destination (target position) may be updated sequentially.

With this arrangement, the operator of the shovel 100 can move the shovel 100 by a predetermined distance toward the next destination (target position) in the extension direction of the slope by simply pressing the autonomous travel switch, thereby improving the efficiency of the slope finishing operation.

Figure 10:
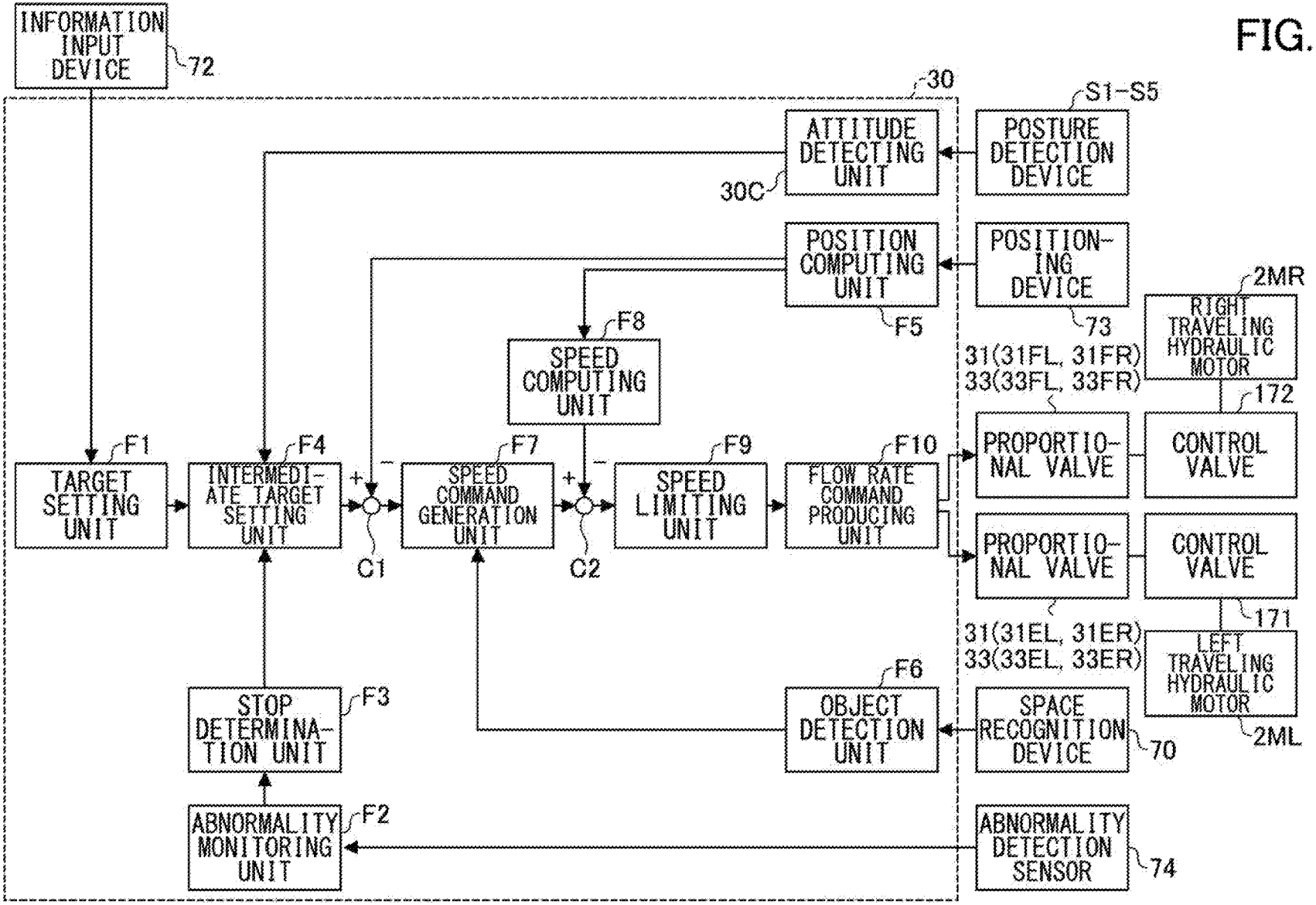
FIG. 10 is a functional block diagram illustrating another structural example of the controller.

Next, another structural example of the controller 30 will be described with reference to FIG. 10. FIG. 10 is a functional block diagram illustrating another example of a configuration of the controller 30. In the example of FIG. 10, the controller 30 is configured to receive a signal output by at least one of the attitude detecting device, the space recognition device 70, the information input device 72, the positioning device 73, and the abnormality detection sensor 74, perform various operations, and output control commands to the proportional valve 31 and the proportional valve 33. The attitude detection device includes a boom angle sensor S1, an arm angle sensor S2, a bucket angle sensor S3, a body inclination sensor S4, and a swivel angle velocity sensor S5.

The controller 30 illustrated in FIG. 10 differs from the controller 30 illustrated in FIG. 6 in that the controller 30 is mainly connected to the abnormal detection sensor 74 and has a target setting unit F1, an abnormality monitoring unit F2, a stop determination unit F3, an intermediate target setting unit F4, a position computing unit F5, an object detection unit F6, a speed command generation unit F7, a speed computing unit F8, a speed limiting unit F9, and a flow rate command producing unit F10. Therefore, the description of the common parts is omitted and the differences are described in detail below.

The attitude detection unit 30C is configured to detect information about the attitude of the shovel 100. In the example of FIG. 10, the attitude detection unit 30C determines whether the position of the shovel 100 is a traveling attitude. The attitude detection unit 30C is configured to allow execution of autonomous traveling of the shovel 100 when it is determined that the attitude of the shovel 100 is a traveling attitude.

The target setting unit F1 is configured to set the target for autonomous traveling of the shovel 100. In the example of FIG. 10, based on the output of the information input device 72, the target setting unit F1 sets the destination (target position) as the destination when the shovel 100 is autonomously driven and sets a target as the traveling route to the destination (target position) or the like. Specifically, the target setting unit F1 sets the destination selected by the operator of the shovel 100 using the touch panel (see, for example, the target graphic G11 of FIG. 7) or the destination automatically estimated (see, for example, the graphic 100Y of FIG. 9) as the target position, and sets the traveling route selected by the operator of the shovel 100 using the touch panel (see, for example, the traveling route graphic G12 of FIG. 7) or the traveling route automatically estimated (see, for example, the traveling route indicated by an arrow AR1 of FIG. 9) as the target route. The operator may not only set the destination (target position) using the display device D1 of the shovel 100, but may also set the destination (target position) by remote control from the outside of the shovel 100 using at least one of the support devices 200 and the management device 300 described below.

The abnormality monitoring unit F2 is configured to monitor the abnormality of the shovel 100. In the example of FIG. 10, the abnormality monitoring unit F2 determines the degree of abnormality of the shovel 100 based on the output of the alarm detecting sensor 74. The abnormality detection sensor 74 is at least one of a sensor for detecting the abnormality in the engine 11 and the sensor for detecting the abnormality in relation to the temperature of the hydraulic oil, a sensor for detecting the abnormality in the controller 30, and the like.

The stop determination unit F3 is configured to determine whether it is necessary to stop the shovel 100 based on various information. In the example of FIG. 10, the stop determination unit F3 determines whether it is necessary to stop the shovel 100 during autonomous traveling based on the output of the abnormality monitoring unit F2. Specifically, the stop determination unit F3 determines that it is necessary to stop the shovel 100 during autonomous traveling when the degree of abnormality of the shovel 100 determined by the abnormality monitoring unit F2 exceeds a predetermined degree. In this case, for example, the controller 30 controls the traveling hydraulic motor 2M as a traveling actuator to slow down or stop the rotation of the traveling hydraulic motor 2M. Meanwhile, for example, when the degree of abnormality of the shovel 100 determined by the abnormality monitoring unit F2 is less than a predetermined degree, the stop determination unit F3 determines that it is not necessary to stop the shovel 100 during autonomous traveling, Said differently, it is possible to continue autonomous traveling of the shovel 100. When the operator mounts on the shovel 100, the stop determination unit F3 may determine whether autonomous driving is canceled or not in addition to whether it is necessary to stop the shovel 100.

The intermediate target setting unit F4 is configured to set an intermediate target for the autonomous traveling of the shovel 100. In the example of FIG. 10, when it is determined by the attitude detection unit 30C that the attitude of the shovel 100 is in the driving attitude and it is determined by the stop determination unit F3 that it is not necessary to stop the shovel 100, the intermediate target setting unit F4 divides the target route set by the target setting unit F1 into a plurality of sections and sets the end point of each section as the intermediate target position.

The position computing unit F5 is configured to compute the present position of the shovel 100. In the example of FIG. 10, the position computing unit F5 computes the present position of the shovel 100 based on the output of the positioning device 73. When the shovel is engaged in the slope work, the target setting unit F1 may set the end position of the slope work as the final target position. The intermediate target setting unit F4 may divide the slope work from the start position to the end position into a plurality of sections and set the end point of each section as the intermediate target position.

The computing unit C1 is configured to compute the difference between the intermediate target position set by the intermediate target setting unit F4 and the present position of the shovel 100 computed by the position computing unit F5.

The object detection unit F6 is configured to detect an object present around the shovel 100. In the example of FIG. 10, the object detection unit F6 detects an object present around the shovel 100 based on the output of the spatial recognition device 70. The object detection unit F6 generates a stop command for stopping autonomous traveling of the shovel 100 when the object (for example, a person) present in the traveling direction of the shovel 100 during autonomous traveling is detected.

The speed command generation unit F7 is configured to generate a command regarding the traveling speed. In the example of FIG. 10, the speed command generation unit F7 generates the speed command based on the difference computed by the computing unit C1. Basically, the speed command generation unit F7 is configured to generate a speed command that is larger as the difference is larger. The speed command generation unit F7 is configured to generate a speed command that makes the difference computed by the computing unit C1 close to zero.

The speed command generation unit F7 may change the value of the speed command when it is determined that the shovel 100 is present on a sloping land based on the previously input information on a land form and the detected value of the positioning device 73. For example, when it is determined that the shovel 100 is on a downhill slope, the speed command generation unit F7 may generate a speed command corresponding to a speed that is slower than an ordinary speed. The speed command generation unit F7 may acquire information about the terrain, such as the inclination of the ground, by the spatial recognition device 70. In addition, even when it is determined that the surface of the road is large in the light of the signal from the space recognition device 70 (for example, when it is determined that a large number of stones are present on the surface of the road), the speed command generation unit F7 may generate a speed command corresponding to the speed that is decelerated from the normal speed. As described above, the speed command generation unit F7 may change the value of the speed command based on the information on the road surface in the traveling route. For example, when the shovel 100 moves from sand to gravel in a riverbed, the speed command generation unit F7 may automatically change the value of the speed command. Therefore, the speed command generation unit F7 can change the traveling speed corresponding to the road surface condition. Further, the speed command generation unit F7 may generate the speed command corresponding to the operation of the attachment. For example, when the shovel 100 is engaged in the slope work (specifically, when the excavation attachment AT is engaged in the finishing work from the top of the slope to the foot of the slope), the intermediate target setting unit F4 sets the end (end point) of the next section as the target position when it is determined that the bucket 6 has reached the butt of the shoulder. The speed command generation unit F7 generates the speed command to the target position in the next section. Alternatively, when it is determined that the boom 4 has risen to a predetermined height after the bucket 6 has reached the butt, the intermediate target setting unit F4 sets the end (end point) of the next section as the target position. The speed command generation unit F7 may generate the speed command to the next target position. In this manner, the speed command generation unit F7 may set the target position in response to the operation of the attachment.

Additionally, the controller 30 may include a mode setting unit for setting an operation mode of the shovel 100. In this case, when a crane mode is set as an operation mode of the shovel 100, or when a slow speed mode, such as a slow-speed high-torque mode, is set, the speed command generation unit F7 generates the speed command corresponding to the slow mode. As described above, the speed command generation unit F7 can change the traveling speed depending on the state of the shovel 100.

The speed computing unit F8 is configured to compute the current traveling speed of the shovel 100. In the example of FIG. 10, the speed computing unit F8 computes the current traveling speed of the shovel 100 based on the transition of the present position of the shovel 100 computed by the position computing unit F5.

The computing unit C2 is configured to compute the difference between the traveling speed corresponding to the speed command generated by the speed command generation unit F7 and the current traveling speed of the shovel 100 computed by the speed computing unit F8.

The speed limiting unit F9 is configured to limit the speed of the shovel 100. In the example of FIG. 10, the speed limiting unit F9 is configured to output a limit value instead of a speed difference when the speed difference computed by the computing unit C2 exceeds the limit value, and output the speed difference directly when the speed difference computed by the computing unit C2 is equal to or less than the limit value. The limit may be a previously registered value or a dynamically computed value.

The flow rate command producing unit F10 is configured to generate a command related to the flow rate of the hydraulic oil fed from the main pump 14 to the traveling hydraulic motor 2M. In the example of FIG. 10, the flow rate command producing unit F10 generates the flow instruction based on the speed difference output by the speed limiting unit F9. Basically, the flow rate command producing unit F10 is configured to generate a flow rate command that is larger as the speed difference in the speed is larger. The flow rate command producing unit F10 is configured to generate a flow rate command for bringing the speed difference computed by the computing unit C2 close to zero.

The flow rate command generated by the flow rate command producing unit F10 is an electric current command for each of the proportional valves 31EL, 31ER, 31FL, 31FR, 33EL, 33ER, 33FL, and 33FR (see FIGS. 5A and 5B). The proportional valves 31EL and 33EL operate in response to their electric current commands to vary the pilot pressure acting on the left pilot port of the controlling valve 171. Therefore, the flow rate of the hydraulic oil flowing into the left traveling hydraulic motor 2ML is adjusted to be the flow rate corresponding to the flow rate command generated by the flow rate command producing unit F10. The proportional valves 31ER and 33ER operate in the same manner. The proportional valves 31FR and 33FR also operate in response to their electric current commands to vary the pilot pressure acting on the right pilot port of the controlling valve 172. Therefore, the flow rate of the hydraulic oil flowing into the right traveling hydraulic motor 2MR is adjusted to be the flow rate corresponding to the flow rate command generated by the flow rate command producing unit F10. The proportional valves 31 FL and 33 FL operate in the same manner. As a result, the traveling speed of the shovel 100 is adjusted to be the traveling speed corresponding to the speed command generated by the speed command generation unit F7. The traveling speed of the shovel 100 is a concept including a traveling direction. The traveling direction of the shovel 100 is determined on the basis of the rotation speed and rotation direction of the left traveling hydraulic motor 2ML and the rotation speed and rotation direction of the right traveling hydraulic motor 2MR.

Incidentally, in the above described example, an example in which a flow command generated by the flow rate command producing unit F10 is output to the proportional valve 31 is illustrated. However, the controller 30 is not limited to this structure. Ordinarily, an actuator other than the traveling hydraulic motor 2M, such as the boom cylinder 7, is not operated during the traveling action. For this reason, the flow instruction generated by the flow rate command producing unit F10 may be output to the regulator 13 of the main pump 14. In this case, the controller 30 can control the traveling action of the shovel 100 by controlling the discharge amount of the main pump 14. The controller 30 may control steering of the shovel 100 by controlling each of the left regulator 13L and the right regulator 13R. Said differently, by controlling the discharge amount of each of the left main pump 14L and the right main pump 14R. Further, the controller 30 may control the operation by controlling the amount of the hydraulic oil supplied to each of the left traveling hydraulic motor 2ML and the right traveling hydraulic motor 2MR by the proportional valve 31 and control the operation by controlling the regulator 13 to control the traveling speed.

With this structure, the controller 30 can realize autonomous traveling of the shovel 100 from the present position to the target position.

As described above, the shovel 100 according to the embodiment of the present invention includes the lower traveling body 1, the upper swiveling body 3 that is mounted on the lower traveling body 1 so as to be able to swivel, a traveling actuator that drives the lower traveling body 1, and a controller 30 as a control device that is provided to the upper swiveling body 3. The controller 30 is configured to operate a traveling actuator based on information about a target position. The traveling actuator is, for example, a traveling hydraulic motor 2M. It may be a traveling electric motor. This arrangement allows the shovel 100 to reduce the burden on the traveling operation. This is because shovel 100 can be driven without having to continuously operate at least one of the drive lever 26D and the drive pedal.

The shovel 100 may include a positioning device 73 for measuring the present position and a direction detection device 71 for detecting information regarding the relative relationship between the direction of the upper swiveling body 3 and the direction of the lower traveling body 1. In this case, the controller 30 may operate a control valve for the traveling actuator based on the output of the positioning device 73 and the output of the direction detector 71. For example, at least one of the controlling valves 171 for the left-traveling hydraulic motor 2ML and 172 for the right-traveling hydraulic motor 2MR can be displaced even if neither the traveling lever 26D nor the traveling pedal is operated. With this arrangement, the controller 30 can autonomously drive the shovel 100 while controlling the position and direction of the shovel 100.

The shovel 100 may include an information acquisition device E1 for acquiring information on the construction state. In this case, the controller 30 may set the driving route based on the information on the target position and the information on the construction state and allow the lower traveling body 1 to travel along the traveling route. Alternatively, the controller 30 may set a traveling route based on past travel trajectories and allow the lower traveling body 1 to travel along the traveling route. In this manner, the shovel 100 may be configured to autonomously travel along a traveling route set in various ways. With this arrangement, the shovel 100 reduces the burden on the operator with respect to the driving operation.

The controller 30 may be driven by the lower traveling body 1 in a state in which the direction of the upper swiveling object 3 is aligned with the direction of the lower traveling body 1, and may travel by the lower traveling body 1 in a state in which the direction of the upper swiveling object 3 is different from the direction of the lower traveling body 1. With this structure, the controller 30 may allow the shovel 100 to travel in an appropriate position depending on the distance at which the shovel 100 is driven autonomously and the condition of the route to travel.

The preferred embodiment of the present invention has been described in detail above. However, the invention is not limited to the embodiments described above. Various modifications, substitutions, and the like may be applied to the embodiments described above without departing from the scope of the invention. Also, the features described separately may be combined unless there is a technical inconsistency.

For example, in the embodiment described above, a hydraulic operating system with a hydraulic pilot circuit is disclosed. For example, in the hydraulic pilot circuit for the left operation lever 26L, hydraulic oil fed from the pilot pump 15 to the left operation lever 26L is transferred to the pilot ports of the control valves 176L, 176R at a flow rate proportional to the opening of the remote control valve which is opened and closed by tilting the left operation lever 26L in the arm stretching direction. Alternatively, in the hydraulic pilot circuit related to the right operation lever 26R, the hydraulic oil supplied from the pilot pump 15 to the right operation lever 26R is transferred to the pilot ports of the control valves 175L, 175R at a flow rate corresponding to the opening of the remote control valve which is opened and closed by tilting the right operation lever 26R in the boom heightening direction.

However, rather than the hydraulic operating system with such a hydraulic pilot circuit, an electric operating system with an electric pilot circuit may be employed. In this case, the lever operation amount of the electric operation lever in the electric operation system is input to the controller 30, for example, as an electric signal. An electromagnetic valve is also disposed between the pilot pump 15 and the pilot port of each control valve. The electromagnetic valves are configured to operate in response to the electric signal from the controller 30. This arrangement allows the controller 30 to control the electromagnetic valves by an electric signal corresponding to the lever operation amount operated to increase or decrease the pilot pressure to move each control valve when it is manually operated using the electric operation lever. Each control valve may be composed of an electromagnetic spool valve. In this case, the electromagnetic spool valve operates in response to electric signals from the controller 30 corresponding to the level of lever operation of the electric operation lever.

Figure 11:
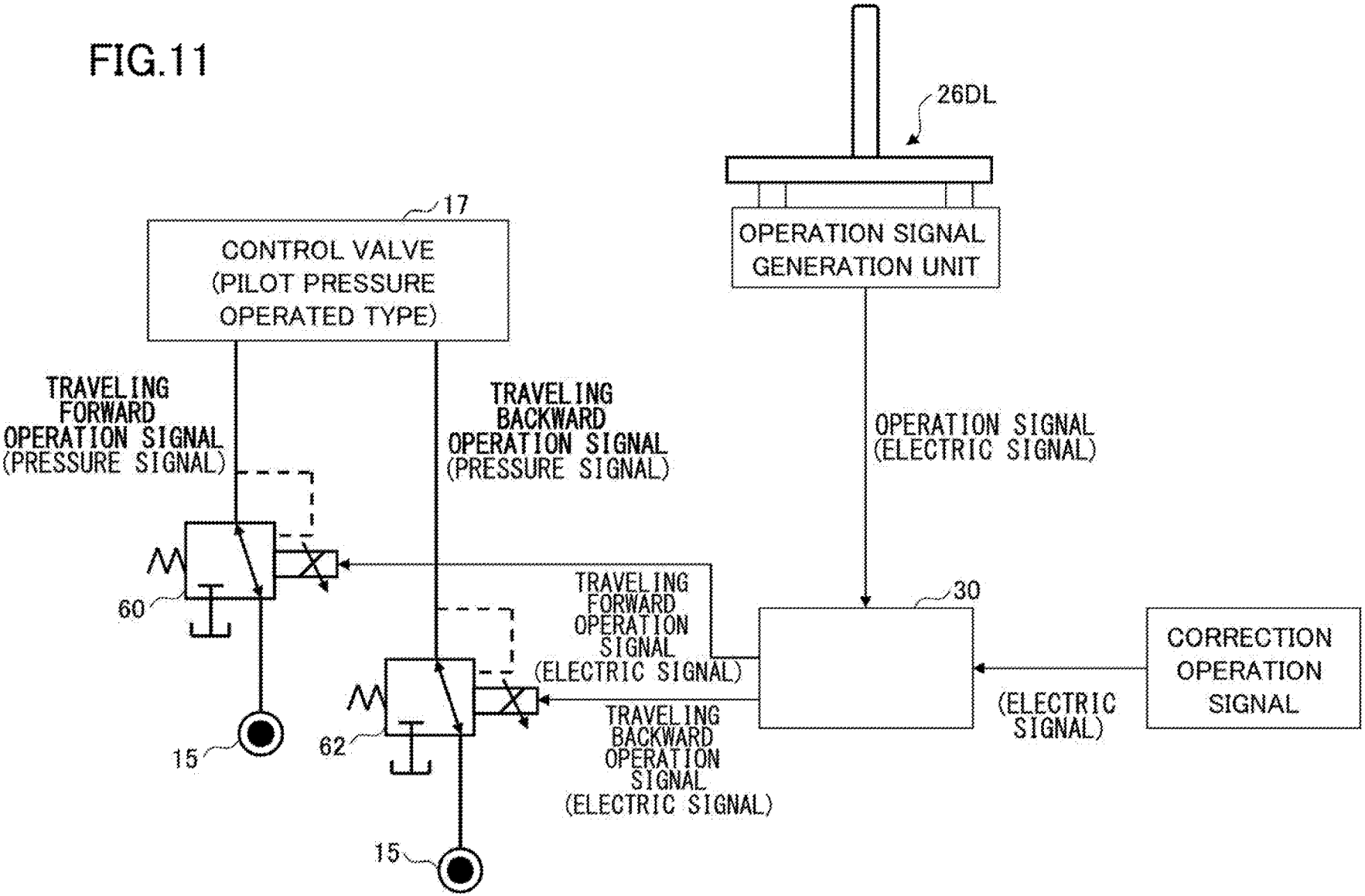
FIG. 11 illustrates a structural example of an electric operation system.

When an electric control system with an electric operation lever is employed, the controller 30 can perform an autonomous control function more easily than when a hydraulic control system with a hydraulic control lever is employed. FIG. 11 illustrates an example of the structure of the electric operating system. Specifically, the electric operation system of FIG. 11 is an example of a left traveling operation system for rotating the left traveling hydraulic motor 2ML. The electric operation system mainly is formed by the control valve 17 of a pilot pressure operated type, a left traveling lever 26DL as the electric operation lever, the controller 30, an electromagnetic valve 60 for left forward traveling operation, and an electromagnetic valve 2 for left backward traveling operation. The electric operation system of FIG. 11 may also be applied to a swivel operation system for swiveling the upper swiveling body 3, a boom operation system for moving the boom 4 up and down, an arm operation system for opening and closing the arm 5, a bucket operation system for opening and closing the bucket 6, and the like.

The control valve 17 of a pilot pressure operated type includes a controlling valve 171 (see FIG. 3) for the left traveling hydraulic motor 2ML, a controlling valve 172 (see FIG. 3) for the right traveling hydraulic motor 2MR, a controlling valve 173 (see FIG. 3) for the swiveling hydraulic motor 2A, a controlling valve 175 (see FIG. 3) for the boom cylinder 7, a controlling valve 176 (see FIG. 3) for the arm cylinder 8, and a controlling valve 174 (see FIG. 3) for the bucket cylinder 9. The electromagnetic valve 60 is configured to adjust the pressure of the hydraulic oil in the tube that connects the pilot pump 15 with a forward traveling side pilot port of the controlling valve 171. The electromagnetic valve 62 is configured to adjust the pressure of the hydraulic oil in the tube that connects the pilot pump 15 with a backward traveling side pilot port of the controlling valve 171.

When a manual operation is conducted, the controller 30 generates a forward traveling operation signal (electric signal) or backward traveling operation signal (electric signal) in response to the operation signal (electric signal) output by the operation signal generation unit of the left traveling lever 26DL. The operation signal output by the operation signal generation unit of the left traveling lever 26DL is an electric signal that varies according to the operation amount and operation direction of the left traveling lever 26DL.

Specifically, when the left traveling lever 26DL is operated in the traveling forward direction, the controller 30 outputs a traveling forward operation signal (electric signal) corresponding to the lever operation amount to the electromagnetic valve 60. The electromagnetic valve 60 operates in response to the traveling forward operation signal (electric signal) to control the pilot pressure as a traveling forward operation signal (pressure signal) acting on the forward pilot port of the controlling valve 171. Similarly, when the left traveling lever 26DL is operated in the backward traveling direction, the controller 30 outputs the traveling backward operating signal (electric signal) corresponding to the lever operation amount to the electromagnetic valve 62. The electromagnetic valve 62 operates in response to the traveling backward operation signal (electric signal) to control the pilot pressure as a backward operation signal (pressure signal) acting on the traveling backward side pilot port of the controlling valve 171.

When autonomous control is performed, the controller 30 generates the traveling forward operation signal (electric signal) or the traveling backward operation signal (electric signal) in accordance with a correction operation signal (electric signal) instead of, for example, responding to the operation signal (electric signal) output by the operation signal generation unit of the left traveling lever 26DL. The correction operation signal may be an electric signal generated by the controller 30 or an electric signal generated by a controller or the like other than the controller 30.

Figure 12:
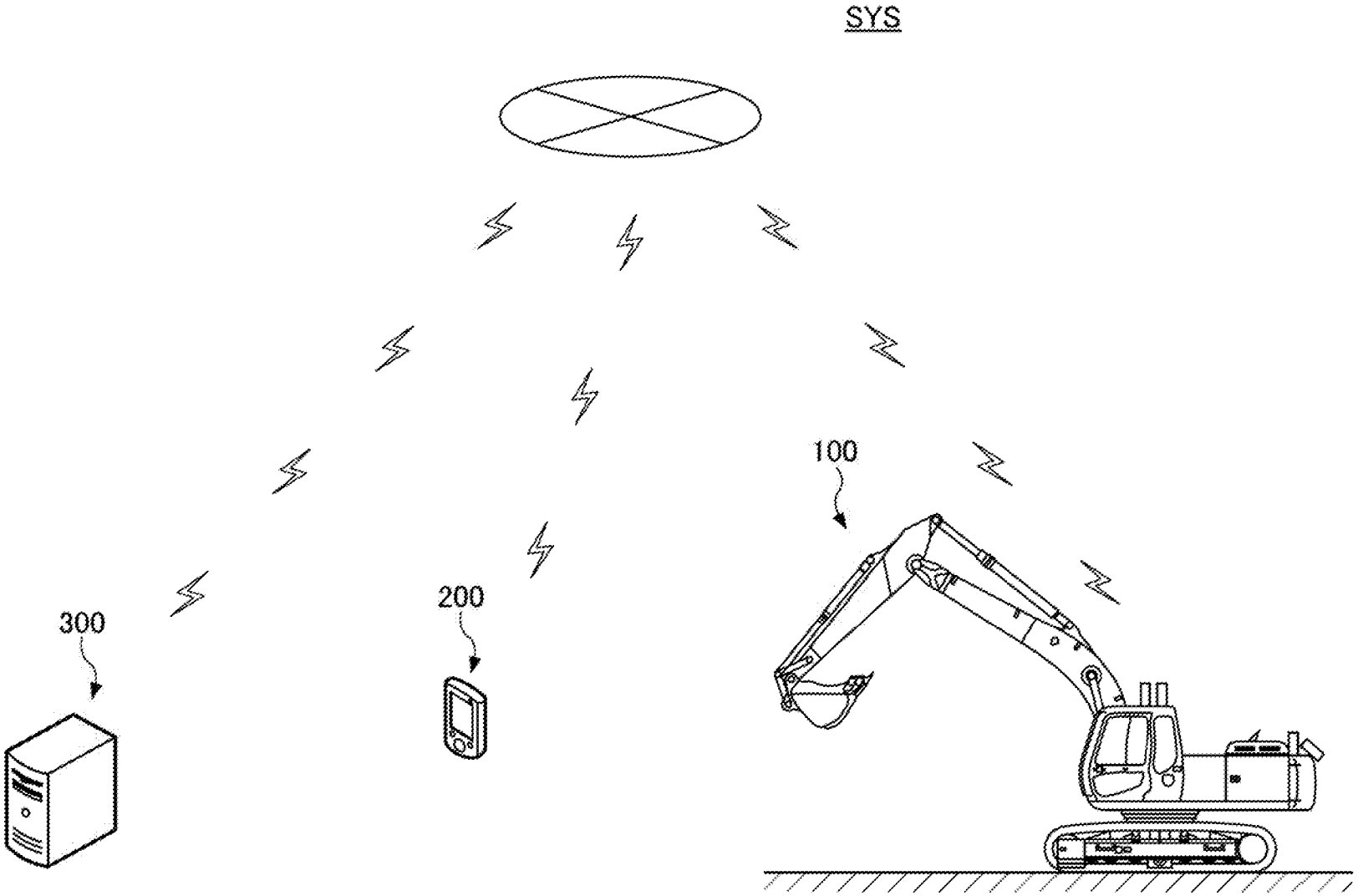
FIG. 12 is a schematic diagram illustrating a structural example of a management system of the shovel.

The information obtained by the shovel 100 may be shared with a manager and another operator of the shovel through the shovel management system SYS as illustrated in FIG. 12. FIG. 12 is a schematic diagram illustrating an example of the structure of the shovel management system SYS. The management system SYS is a system that manages one or more shovels 100. In this embodiment, the management system SYS includes primarily a shovel 100, an assistive device 200, and a management device 300. Each of the shovel 100, the assistive device 200, and the management device 300 forming the management system SYS may be a single unit or multiple units. In the example of FIG. 12, the management system SYS includes one shovel 100, one assistive device 200, and one management device 300.

The assistive device 200 is typically a portable terminal device, such as a notebook PC, tablet PC, or smartphone carried by a worker or the like at a construction site. The assistive device 200 may be a portable terminal device carried by an operator of the shovel 100. Assistive device 200 may be a fixed terminal device.

The management device 300 is typically a fixed terminal device. For example, a server computer installed in a management center or the like outside a construction site. The management device 300 may be a portable computer (e.g., a portable terminal device such as a notebook PC, tablet PC, or smartphone).

At least one of the assistive devices 200 and the management device 300 may include a monitor and operation device for a remote control device. In this case, the operator may operate the shovel 100 using the remote control device. The remote control device is connected to a controller 30 mounted on a shovel 100 via, for example, a wireless communication network, such as a wireless communication network, a cellular telephone communication network, or a satellite communication network.

The setting screen GS illustrated in FIGS. 7 and 8 is typically displayed as a display device D1 located in the cabin 10, but may be displayed as a display device connected to at least one of the assistive device 200 and the management device 300. To enable a worker using the assistive device 200 or an administrator using the management device 300 to set a target position or set a target route, etc. In the SYS of the management system of the shovel 100 described above, the controller 30 of the shovel 100 may transmit information about at least one of the time and location when the autonomous travel switch is pressed, the target route utilized when the shovel 100 is moved autonomously (during autonomous travel), and the path actually traced by the predetermined portion during autonomous travel to at least one of the assistive device 200 and the management device 300. The controller 30 may then transmit at least one of the outputs of the space recognition device 70 and an image captured by a single input camera to at least one of the assistants 200 and the management 300. The image may be a plurality of images captured during the autonomous travel. Additionally, the controller 30 may transmit information about at least one of the assistive device 200 and the management device 300, such as data about the operation of the shovel 100 during autonomous travel, data about the attitude of the shovel 100, and data about the attitude of the excavation attachment. To make information about the shovel 100 in autonomous traveling available to the operator using the assistive device 200 or to the administrator using the management device 300.

Thus, the management system SYS of the shovel 100 according to the embodiment of the present invention enables information about the shovel 100 to be acquired the during autonomous travel to be shared with the manager and the other operator of the shovel.

The above-described means provide a shovel that can reduce burden on a traveling operation.

1: Lower traveling body; 1C: Crawler; 1CL: Left crawler; 1CR: Right crawler; 2: Swiveling mechanism; 2A: Swiveling hydraulic motor; 2M: Traveling hydraulic motor; 2ML: Left traveling hydraulic motor; 2MR: Right traveling hydraulic motor; 3: Upper swiveling body; 4: Boom; 5; Arm; 6: Bucket; 7: Boom cylinder; 8: Arm cylinder; 9: Bucket cylinder; 10: Cabin; 11: Engine; 13: Regulator; 14: Main pump; 15: Pilot pump; 17: Control valve; 18: Choke; 19: Control pressure sensor; 26: Operation device; 26D: Traveling lever; 26DL: Left traveling lever; 26DR: Right traveling lever; 26L: Left operation lever; 26R: Right operation lever; 28: Discharge pressure sensor; 29, 29DL, 29DR, 29LA, 29LB, 29RA, 29RB: Operation pressure sensor; 30: Controller; 30A: Setting unit; 30B: Autonomous control unit; 30C: Attitude detecting unit; 31, 31AL-

31FL, 31AR-31FR: Proportional valve; 32, 32AL-32FL, 32AR-32FR: Shuttle valve; 33, 33AL-33FL, 33AR-33FR: Proportional valve; 40: Center bypass tube; 42: Parallel tube; 60, 62: Electromagnetic valve; 70: Space recognition device; 70F: Frontward sensor; 70B: Backward sensor; 70L: Leftward sensor; 70R: Rightward sensor; 100: Shovel; 71: Direction detection device; 72: Information input device; 73: Positioning device; 74: Abnormality detection sensor; 171-176: control valve; AT: Excavation attachment; D1: Display device; D2: Voice output device; E1: Information acquisition device; F1: Target setting unit; F2: Abnormality monitoring unit; F3: Stop determination unit; F4: Intermediate target setting unit; F5: Position computing unit; F6: Object detection unit; F7: Speed command generation unit; F8: Speed computing unit; F9: Speed limiting unit; F10: Flow rate command producing unit; S: Switch; S1: Boom angle sensor; S2: Arm angle sensor; S3: Bucket angle sensor; S4: Body inclination sensor; S5: Swivel angular velocity sensor; and SYS: management system.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority or inferiority of the invention. Although a shovel has been described in detail, it should be understood that various changes, substitutions, and alterations could be made thereto without departing from the spirit and scope of the invention.

What is claimed is:

1. A shovel comprising:

a lower traveling body;

an upper swiveling body swivelably mounted on the lower traveling body;

a traveling actuator that drives the lower traveling body; and a control device provided in the upper swiveling body, wherein the control device operates the traveling actuator to move the lower traveling body toward an intermediate target that is generated based on information about a target position.

2. The shovel according to claim 1, further comprising:

a positioning device that measures a present position; and a direction detection device that detects information related to a relative relationship between a direction of the upper swiveling body and a direction of the lower traveling body, wherein the control device operates a control valve related to the traveling actuator based on an output from the positioning device and an output from the direction detection device.

3. The shovel according to claim 1, further comprising:

an information acquisition device that acquires information related to construction state, wherein the control device sets a traveling route based on information related to the target position and information related to the construction state and causes the lower traveling body to travel along the traveling route.

4. The shovel according to claim 1, wherein the controller sets a traveling route based on a past traveling trajectory and causes the lower traveling body to travel along the traveling route.

5. The shovel according to claim 1, wherein the control device causes the lower traveling body to travel in a state where a direction of the upper swiveling body and a direction of the lower traveling body are the same.

6. The shovel according to claim 1, wherein the control device causes the lower traveling body to travel in a state where a direction of the upper swiveling body and a direction of the lower traveling body are different.

7. The shovel according to claim 1, wherein the target position includes a final target position, wherein a traveling route to the final target position is divided into a plurality of sections, and a plurality of target positions are set one for each of the plurality of divided sections as the intermediate target.

8. The shovel according to claim 1, wherein the upper swiveling body includes a positioning device.

9. The shovel according to claim 1, wherein the target position is set by using an image map displayed on a display device.

10. The shovel according to claim 1, further comprising:

an information acquisition device that acquires information on a place of material, a sandbag, a step, a pile or a hole or on a place subjected to surface compaction at a work site in which no road is laid, wherein the control device sets a traveling route to avoid the place in the work site based on the information about the target position and the information acquired by the information acquisition device, and causes the lower traveling body to travel along the traveling route.

11. The shovel according to claim 1, wherein when a direction of the upper swiveling body and a direction of the lower traveling body are different, the control device causes the lower traveling body to travel after aligning the direction of the upper swiveling body with the direction of the lower traveling body if a distance to the target position is more than or equal to a predetermined distance, and causes the lower traveling body to travel with the direction of the upper swiveling body and the direction of the lower traveling body being different if the distance to the target position is less than the predetermined distance.

12. A shovel comprising:

a lower traveling body;

an upper swiveling body swivelably mounted on the lower traveling body;

a traveling actuator that drives the lower traveling body; and a control device provided in the upper swiveling body, wherein the control device is configured to set an intermediate target based on information about a target position, generate a speed command for moving the lower traveling body to the set intermediate target, and limit the generated speed command.

13. The shovel according to claim 12, wherein the control device is configured to set an operation mode of the shovel and generate the speed command corresponding to the set operation mode.

14. The shovel according to claim 12, wherein the control device is configured to change the generated speed command based on road surface information.

15. A shovel comprising:

a lower traveling body;

an upper swiveling body swivelably mounted on the lower traveling body;

an attachment mounted on the upper swiveling body;

a traveling actuator that drives the lower traveling body; and a control device provided in the upper swiveling body, wherein the control device sets an intermediate target for the lower traveling body based on information about a target position in response to an operation of the attachment.

16. The shovel according to claim 15, wherein the target position includes a final target position, wherein a traveling route to the final target position is divided into a plurality of sections, and a plurality of target positions are set one for each of the plurality of divided sections as the intermediate target.

17. The shovel according to claim 15, further comprising:

an attitude detection device, wherein an operation of the attachment is judged by an output from the attitude detection device.

* * * * *